US010189263B2

(12) United States Patent
Matsushita et al.

(10) Patent No.: US 10,189,263 B2
(45) Date of Patent: Jan. 29, 2019

(54) REPLENISHMENT CONTAINER AND INKJET RECORDING DEVICE COMPRISING SAME

(71) Applicant: Hitachi Industrial Equipment Systems Co., Ltd., Chiyoda-ku, Tokyo (JP)

(72) Inventors: Takehiko Matsushita, Tokyo (JP); Naomichi Yoshida, Tokyo (JP); Akira Miyao, Tokyo (JP); Nobuhiro Harada, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 15/650,161

(22) Filed: Jul. 14, 2017

(65) Prior Publication Data

US 2017/0313089 A1 Nov. 2, 2017

Related U.S. Application Data

(63) Continuation of application No. 14/914,805, filed as application No. PCT/JP2013/082120 on Nov. 29, 2013, now Pat. No. 9,738,079.

(51) Int. Cl.
*B41J 2/175* (2006.01)
*B41J 2/18* (2006.01)
(Continued)

(52) U.S. Cl.
CPC ..... *B41J 2/175* (2013.01); *B41J 2/17506* (2013.01); *B41J 2/18* (2013.01); *B65D 51/20* (2013.01); *B41J 2002/1853* (2013.01)

(58) Field of Classification Search
CPC . B41J 2/175; B41J 2/17506; B41J 2/18; B41J 2002/1853; B65D 51/20
See application file for complete search history.

(56) References Cited

U.S. PATENT DOCUMENTS 5,555,673 A * 9/1996 Smith ..... A01M 21/043 118/270
5,907,341 A 5/1999 Miyazawa
(Continued)

FOREIGN PATENT DOCUMENTS

CN 1583411 A 2/2005
JP 9-156120 A 6/1997
(Continued)

OTHER PUBLICATIONS

Chinese-language Office Action issued in counterpart Chinese Application No. 201380078159.9 dated Sep. 25, 2017 (Six (6) pages).
(Continued)

*Primary Examiner* — Anh T. N. Vo
(74) *Attorney, Agent, or Firm* — Crowell & Moring LLP

(57) ABSTRACT

The purpose of the present invention is to provide a replenishment container and an inkjet recording device that are capable of reducing staining by ink or a solvent during ink or solvent replenishing. The replenishment container comprises a storage member having an opening formed therein and having a storage chamber that stores ink or solvent, a stopper member that seals the opening of the storage member, and a lid member that covers the stopper member. The replenishment container is characterized by: comprising a seal member that has a throughhole between the stopper member and the lid member; the lid member having a throughhole that is opened concentrically with the throughhole of the seal member; and the inner diameter of part or all of the throughhole in the seal member being smaller than the inner diameter of the throughhole in the lid member.

10 Claims, 21 Drawing Sheets

(51) Int. Cl.
*B65D 51/20* (2006.01)
*B41J 2/185* (2006.01)

(56) References Cited

U.S. PATENT DOCUMENTS

| | | | | |
|---|---|---|---|---|
| 6,296,353 | B1 | 10/2001 | Thielman et al. | |
| 6,554,411 | B1 | 4/2003 | Hatasa et al. | |
| 6,582,068 | B2 | 6/2003 | Ishizawa et al. | |
| 7,334,889 | B2 | 2/2008 | Sasaki et al. | |
| 7,690,759 | B2 | 4/2010 | Yamada | |
| 8,419,173 | B2 | 4/2013 | Hayashi et al. | |
| 8,646,887 | B2 * | 2/2014 | Ogura | B41J 2/17513 347/84 |
| 9,067,424 | B1 * | 6/2015 | Tominaga | B41J 2/17523 |

FOREIGN PATENT DOCUMENTS

| | | | |
|---|---|---|---|
| JP | 2002-370384 | A | 12/2002 |
| JP | 2011-88639 | A | 5/2011 |

OTHER PUBLICATIONS

International Search Report (PCT/ISA/210) issued in PCT Application No. PCT/JP2013/082120 dated Jan. 14, 2014, with English translation (two (2) pages).

* cited by examiner

REPLENISHMENT CONTAINER AND INKJET RECORDING DEVICE COMPRISING SAME

CROSS REFERENCE TO RELATED APPLICATIONS

This application is a continuation of U.S. patent application Ser. No. 14/914,805, the entire disclosure of which is incorporated herein by reference, the priority of which is claimed, which, on Feb. 26, 2016, entered the U.S. national phase of international application PCT/JP2013/082120, filed Nov. 29, 2013, the entire disclosure of which is also incorporated herein by reference, the priority of which is also claimed.

TECHNICAL FIELD

The present invention relates to a replenishment container and an inkjet recording device provided with the same.

BACKGROUND ART

A background art in the present technical field is Patent Literature 1 (JP-A-9-156120). This publication describes "an engaging member 31 engages with an upper opening 30 of an ink container 11. An ink replenishment port 36 of an ink replenishment container 35 includes a screw 37 on an outer circumferential portion thereof and a spring plug is press-fitted into an opening thereof. The spring plug is constructed of a body 38, a plug 41 and a spring 42, the body 38 is provided with an ink outlet 39 at the center thereof and a ring-shaped protrusion 40 is formed therearound. The spring 42 is built into the body 38 in a compressed state, urging the plug 41 toward the protrusion 40. The plug 41 includes a plurality of grooves 43 forming passages of air and ink when pushed up. The engaging member 31 includes a screw groove 32 that receives the screw 37 of the ink replenishment port 36 formed on the inner surface, four ink inlets 34 on the base plate and is provided at the center with a butting portion 33 against which the spring plug 41 butts." (See Abstract.)

CITATION LIST

Patent Literature

PATENT LITERATURE 1: JP-A-9-156120

SUMMARY OF INVENTION

Technical Problem

Patent Literature 1 describes that the above-described configuration is adopted for the purpose of providing an inkjet recording device that prevents ink from scattering or spilling out when an ink container is replenished with the ink from an ink replenishment container.

However, in the present configuration, ink adheres to the spring plug of the ink replenishment container during ink replenishment and the spring plug is exposed to outside the ink replenishment container when the ink replenishment container is removed, and therefore the ink remaining in the spring plug may drop and cause staining by ink.

In consideration of the above-described problems, it is an object of the present invention to provide a replenishment container capable of reducing staining by ink or a solvent during replenishment of the ink or solvent.

Solution to Problem

In order to solve the above-described problems, for example, the configuration described in the scope of claims is adopted.

The present application includes a plurality of means for solving the above-described problems, and one such example is a replenishment container including a storage member including a storage chamber that stores ink or a solvent and including an opening formed therein, a stopper member that seals the opening of the storage member and a lid member that covers the seal member, the replenishment container including a seal member that has a through hole between the stopper member and the lid member, the lid member including a through hole formed concentrically with the through hole of the seal member and an inner diameter of part or a whole of the through hole of the seal member being smaller than an inner diameter of the through hole of the lid member.

Advantageous Effects of Invention

According to the present invention, it is possible to provide a replenishment container and an inkjet recording device provided with the same capable of reducing staining by ink or a solvent during replenishment of the ink or solvent.

DESCRIPTION OF EMBODIMENTS

Hereinafter, embodiments of the present invention will be described using examples illustrated in the accompanying drawings. Note that the present invention is not limited to the following embodiments.

Embodiment 1

Figure 2:
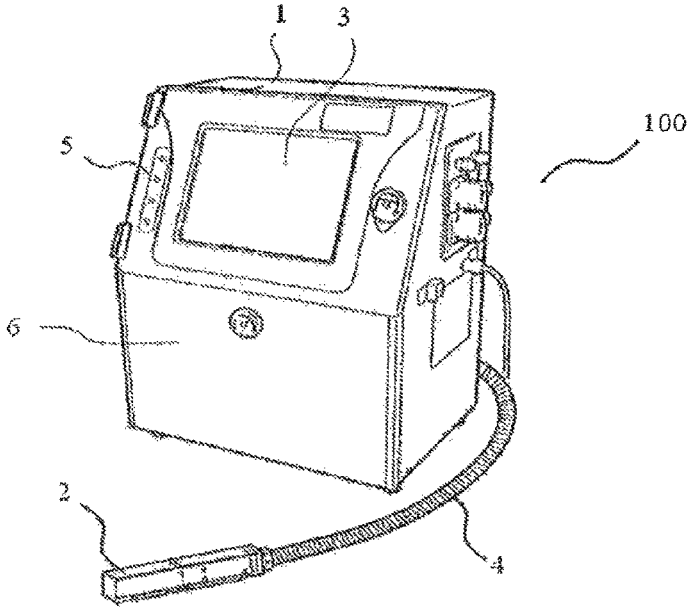
FIG. 2 is a general view illustrating an inkjet recording device mounted with the replenishment container according to Embodiment 1.

FIG. 2 is an overall diagram illustrating an inkjet recording device 100 related to a replenishment container according to the present embodiment. The inkjet recording device 100 is provided with a body 1 including an operation display section 3 provided outside thereof and an ink discharge head 2, and the body 1 and the ink discharge head 2 are connected together via a conduit 4. The body 1 is provided with a state display lamp 5 which can display an operation state of the inkjet recording device 100, for example, a power conduction state, printability state, alarm state or abnormal state by means of lighting up. The inkjet recording device 100 is provided with a maintenance door 6 and the user can perform maintenance such as ink replenishment by opening the maintenance door 6.

Figure 3:
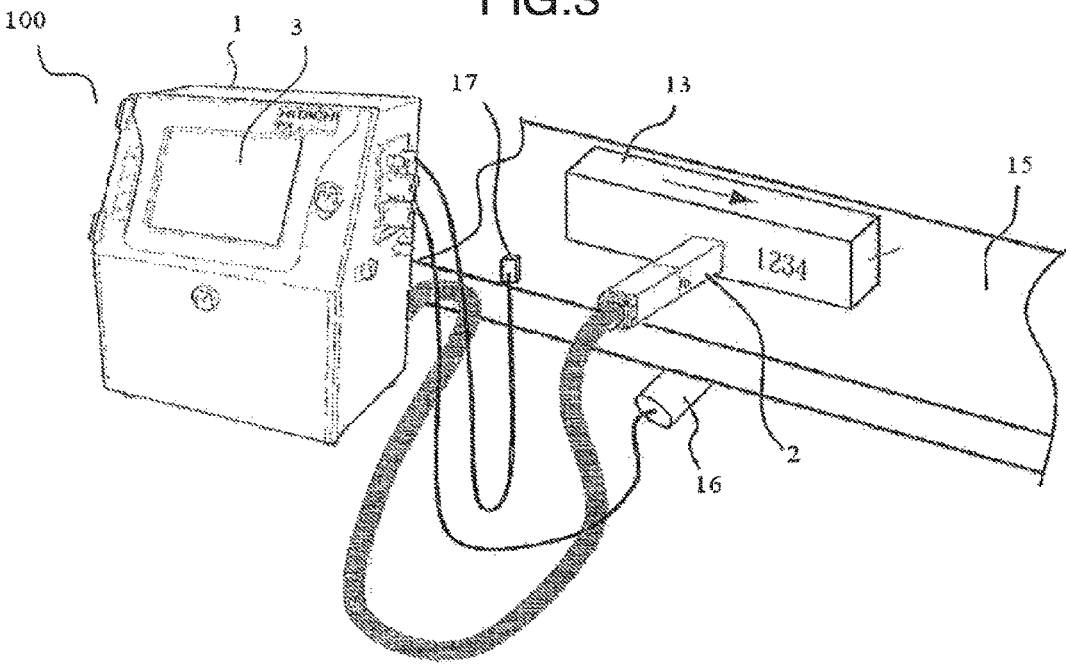
FIG. 3 is a diagram illustrating an example of actual use of the inkjet recording device mounted with the replenishment container according to Embodiment 1.

FIG. 3 illustrates an example of actual use of the inkjet recording device 100. The inkjet recording device 100 is installed, for example, on a production line in a factory where food, beverage or the like is produced, the body 1 is installed at a position where the user can operate it, and the ink discharge head 2 is installed at a position where it can approach a printing target 13 being conveyed on the production line such as a belt conveyor 15.

An encoder 16 that outputs a signal corresponding to a conveying speed to the inkjet recording device 100 to perform printing with the same width irrespective of the conveying speed on the production line such as the belt conveyor 15 and a printing sensor 17 that outputs a signal for detecting the printing target 13 and instructing the inkjet recording device 100 to print it are set, and are respectively connected to a control section 200, which is not shown, in the body 1.

The control section 200 controls the amount of charging and timing of charging with respect to ink particles 10 which are discharged from a nozzle 8 according to signals from the encoder 16 and the printing sensor 17, and causes the ink particles 10 charged and deflected while the printing target 13 is passing through the vicinity of the ink discharge head 2 to adhere to the printing target 13 to perform printing.

Figure 4:
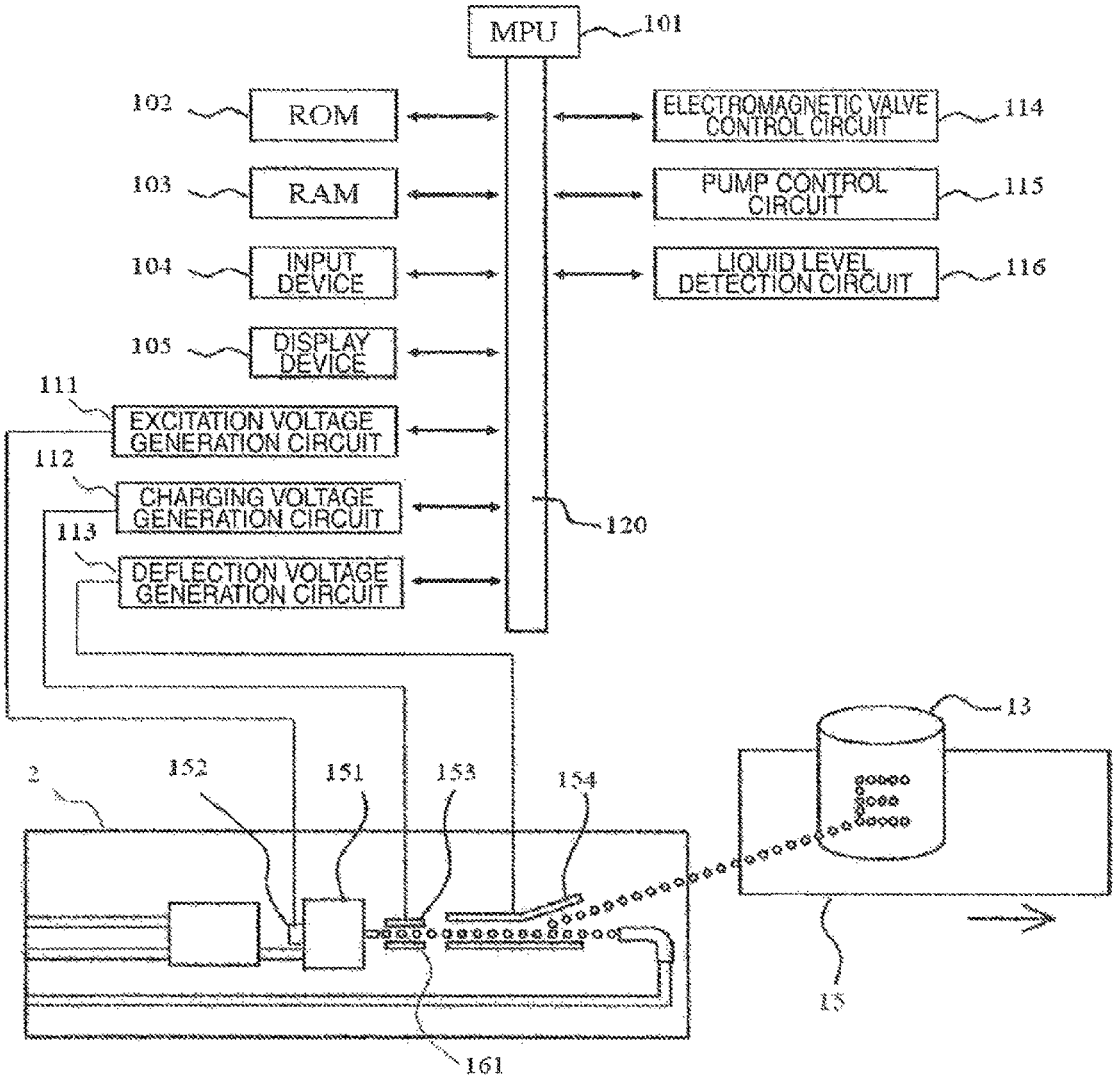
FIG. 4 is a diagram illustrating a control configuration of the inkjet recording device mounted with the replenishment container according to Embodiment 1.

FIG. 4 illustrates a control configuration of the inkjet recording device 100. The control configuration includes a ROM 102 that stores a program and data necessary for an MPU 101 that has a calculation function and control the whole inkjet recording device to operate via a bus 120, a RAM 103 that temporarily stores data necessary during execution of the program, an input device 104 that inputs printing contents, set values or the like and a display device 105 that displays the contents inputted by the input device 104 and a state or the like.

The control configuration also includes connections to an excitation voltage generation circuit 111 that generates an excitation voltage to be given to an excitation element 152 attached to a nozzle 151 inside the ink discharge head 2, a charging voltage generation circuit 112 that generates a charging voltage to be given to a charging electrode 153 to give charge to ink particles 161 discharged from the nozzle 151, a deflection voltage generation circuit 113 that generates a deflection voltage to be given to a deflection electrode 154, an electromagnetic valve control circuit 114 that controls an electromagnetic valve that opens/closes a flow of ink or a solvent, a pump control circuit 115 that controls a pump that gives pressure to the ink, and a liquid level detection circuit 116 that detects liquid levels of an ink container 201, an ink sub container 202 and a solvent sub container 203.

The ink container, the ink sub container and the solvent sub container will be described later.

Figure 5:
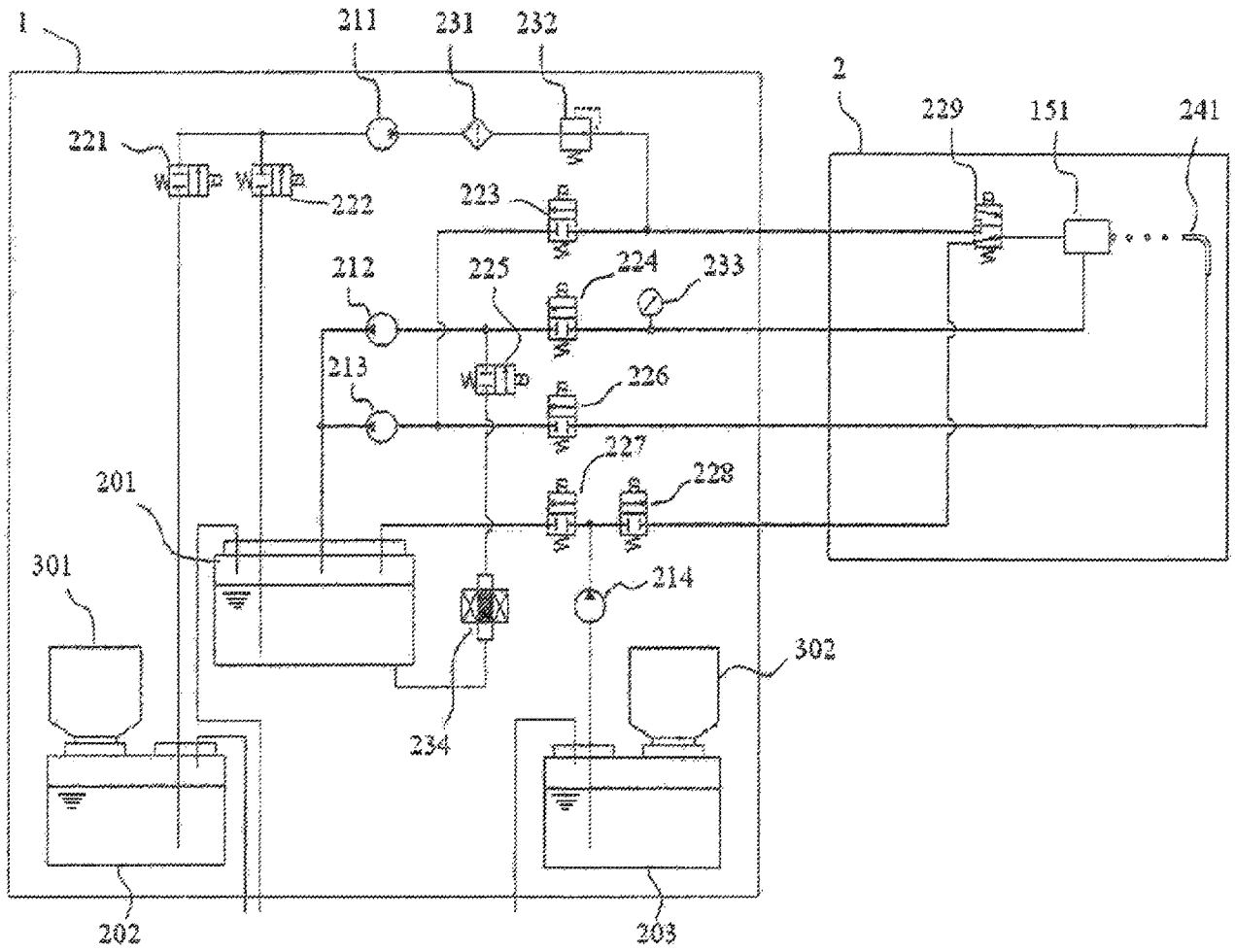
FIG. 5 is a system diagram of an ink circulation system of the inkjet recording device mounted with the replenishment container according to Embodiment 1.

FIG. 5 illustrates a system diagram of an ink circulation system of the inkjet recording device 100. The body 1 is internally provided with the ink container 201 that stores ink to be supplied to the nozzle 151 or recollects and re-stores the ink supplied to the nozzle but not used for printing, the ink sub container 202 that stores ink to be replenished to the ink container 201, the solvent sub container 203 that stores a solvent used to dilute ink or clean the path, pumps 211 to 214 to provide pressure to the ink or solvent, electromagnetic valves 221 to 228 that open/close the path of the ink or solvent, a filter 231 that collects dirt in the ink, a decompression valve 232 that reduces the pressure of the ink increased by the pump 211 and adjusts it to a necessary pressure, a pressure gauge 233 that measures the pressure of the ink, and a viscosity meter 234 that measures viscosity of the ink. The ink discharge head 2 is provided with the nozzle 151, a three-way electromagnetic valve 229 that closes or opens either of the two paths on an IN side to communicate with the path on an OUT side and a gutter 241 that collects the ink discharged from the nozzle but not used for printing.

An ink replenishment container 301 and a solvent replenishment container 302 are connected to the ink sub container 202 and the solvent sub container 203 respectively. Inks in the ink sub container 202 and the solvent sub container 203 are suctioned and press-fed by the pump 211 and the pump 214 respectively, and replenished to the ink container 201 through the paths of the ink and solvent. Though not shown, it is also possible to link to the ink sub container 202, the path connected to the pump 212, the pump 213 and the viscosity meter 234 which are connected to the ink container 201, discard the path from the ink container 201 to the electromagnetic valve 222 and the outside of the body 1, and integrate the ink container 201 and the ink sub container 202.

Figure 7:
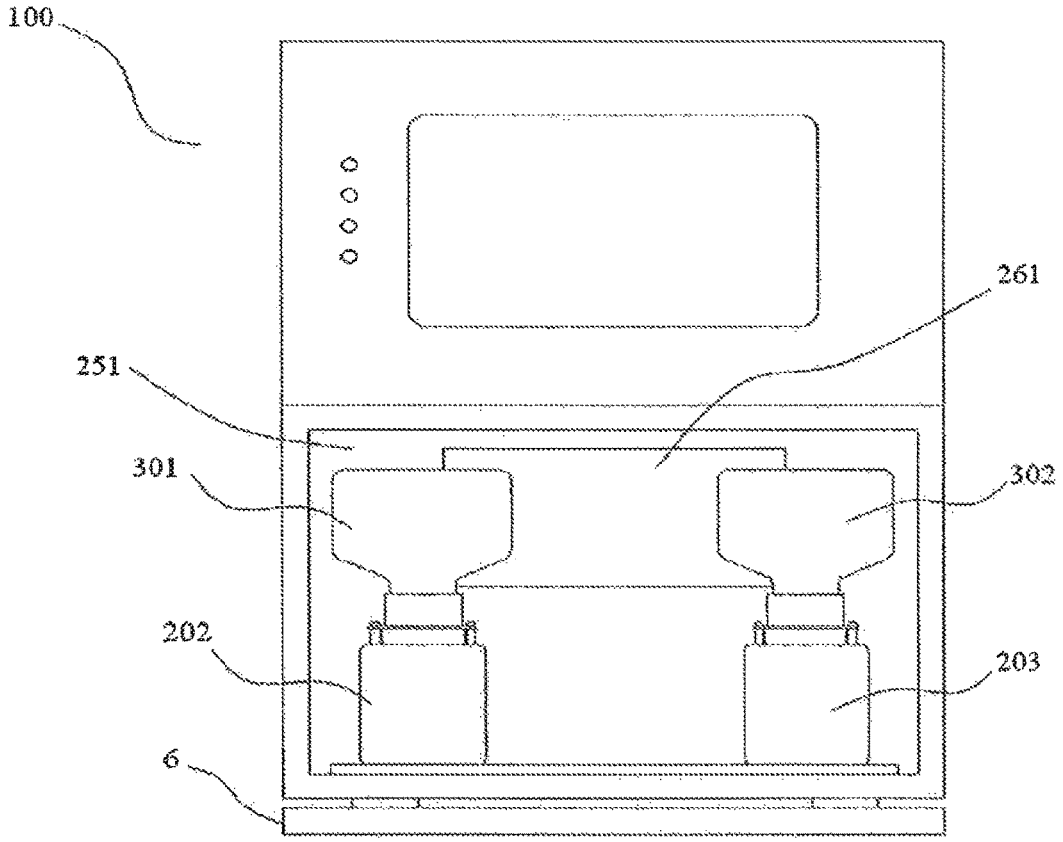
FIG. 7 is an outline view of an ink circulation area of the inkjet recording device mounted with the replenishment container according to Embodiment 1.

FIG. 7 illustrates an outline of an ink circulation area 251 of the inkjet recording device 100. The ink circulation area 251 becomes accessible by opening the maintenance door 6. The ink circulation area 251 is provided with an ink circulation unit 261 in which the pumps 211 to 214 and the electromagnetic valves 221 to 228 are unitized, the ink sub container 202 and the solvent sub container 203, and although these components are not shown, they are fixed by screws or the like.

As described above, the ink replenishment container 301 and the solvent replenishment container 302 are connected to the ink sub container 202 and the solvent sub container 203 respectively, and the ink replenishment container 301 and the solvent replenishment container 302 can be attached/detached or replaced by the user.

Figure 1A:
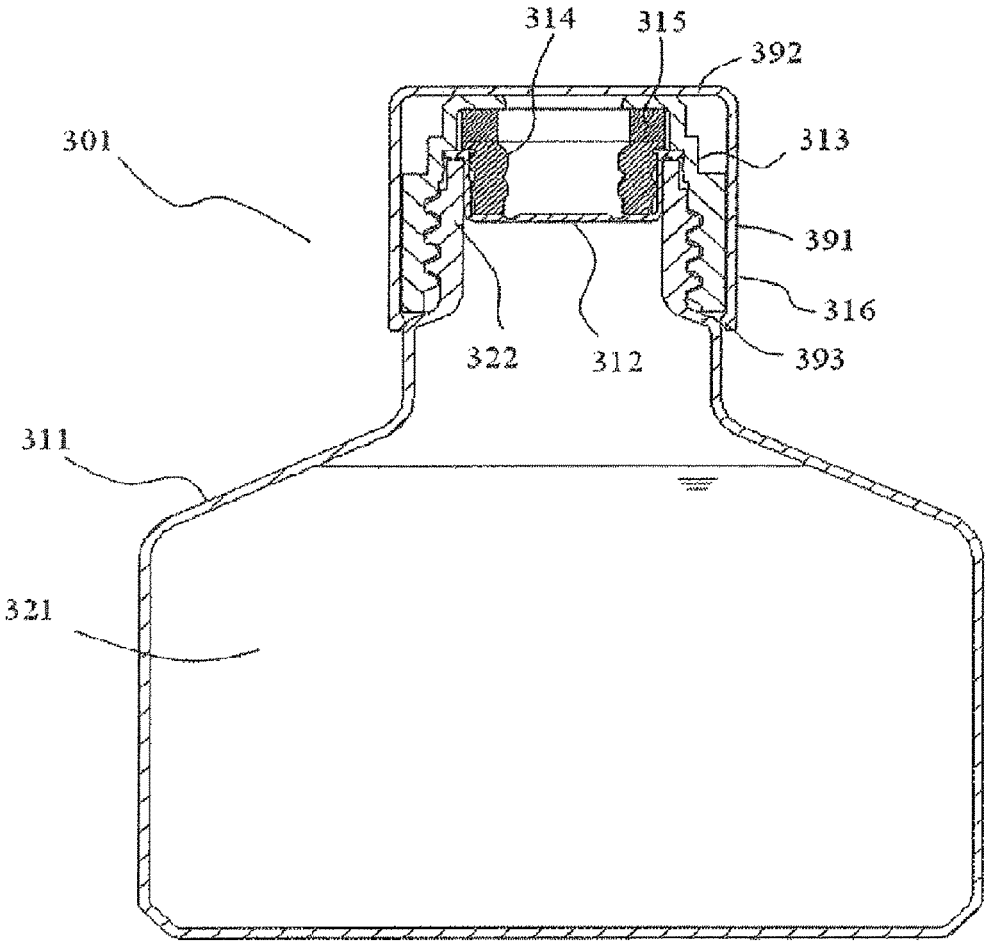
FIG. 1A is a cross-sectional view illustrating an overall structure of an ink replenishment container according to Embodiment 1.
Figure 1B:
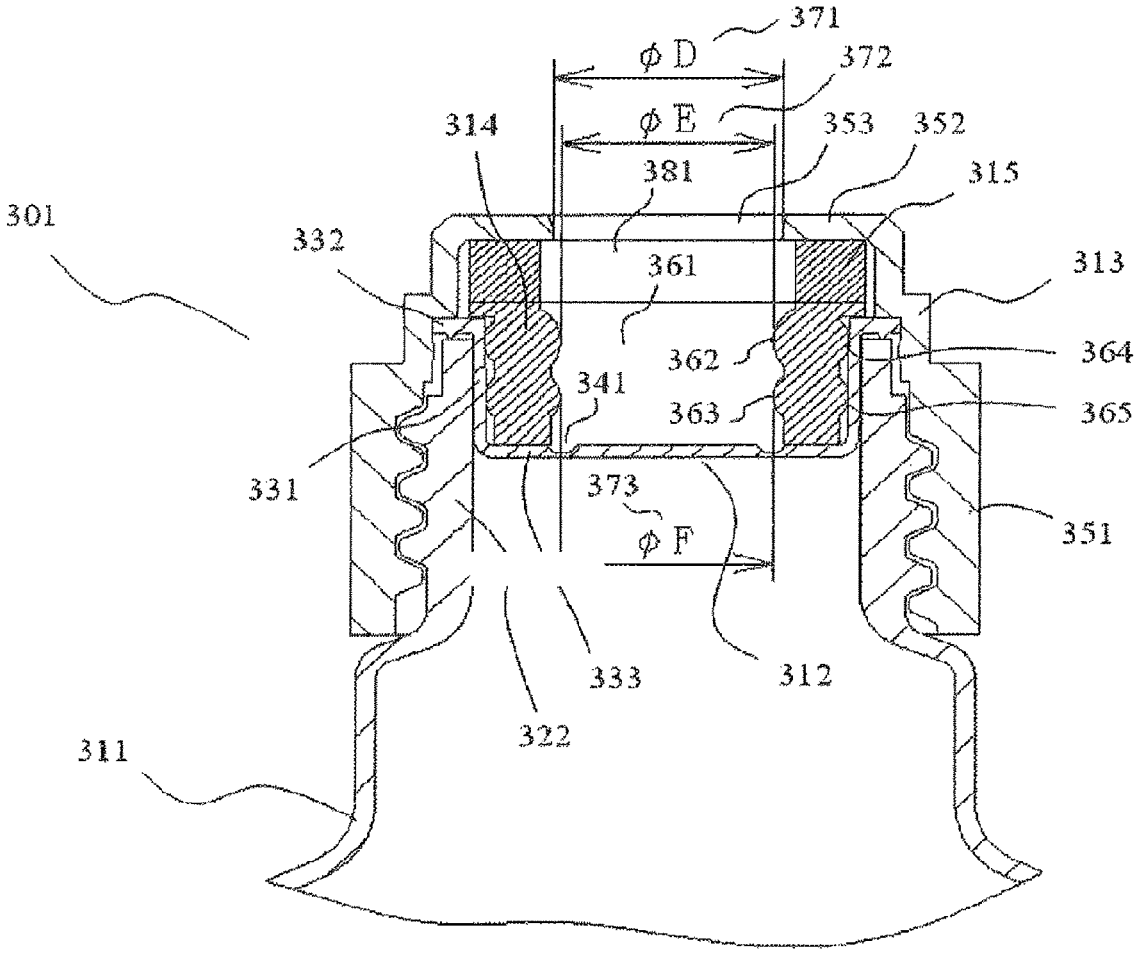
FIG. 1B is a cross-sectional view illustrating a detailed structure of a container connection section of the ink replenishment container according to Embodiment 1.

FIG. 1 illustrates a structure of the ink replenishment container 301 which is the present embodiment. Note that since the ink replenishment container and the solvent replenishment container have similar structures, only the ink replenishment container will be described below, and description of the solvent replenishment container will be omitted.

FIG. 1(*a*) shows an overall structure and FIG. 1(*b*) shows an enlarged view of the distal end portion of the ink replenishment container 301. As shown in FIG. 1(*a*), the ink replenishment container 301 is provided with a storage member 311, a stopper member 312, a first lid member 313, a seal member 314, a liquid absorbing member 315 and a second lid member 316.

As examples of the material of the ink replenishment container 301, high density polyethylene resin (HDPE), low density polyethylene resin (LDPE) or polypropylene resin (PP) is used for the storage member 311, the first lid member 313 and the second lid member 316, and low density polyethylene resin (LDPE) or linear low density polyethylene resin (LLDPE) is used for the stopper member 312.

In addition, isobutylene-isoprene rubber or ethylene-propylene rubber which is an elastic body is used for the seal member 314, and polyolefin-based foamed body with continuous bubbles or polyolefin non-woven fabric cloth is used for the liquid absorbing member 315. Note that the above-described materials are suitable for use in the present embodiment, but other materials may also be used.

Describing a detailed structure of the ink replenishment container 301, the storage member 311 has a storage chamber 321 of a rectangular parallelepiped shape, and a distal end portion 322 of a wall surface that extends from one end portion of the storage chamber 321 has a cylindrical shape and has an open end face.

Furthermore, the outer circumferential rim of the distal end portion 322 is threaded and the wall surface that connects the distal end portion 322 and the storage chamber 321 is tilted toward the inside of the storage member 311.

The stopper member 312 is attached to the opening of this distal end portion 322 so as to be inserted into the storage member 311. The stopper member 312 is provided with a cylindrical portion 331, a flange portion 332 and a base portion 333, the flange portion 332 being formed at an end portion of the cylindrical portion 331, and the stopper member 312 being attached, with this flange portion 332 locked at the opening end portion of the distal end portion 322 of the storage member 311.

With this configuration, an outside surface of the cylindrical portion 331 is continuously in tight contact with an inside surface of the distal end portion 322 of the storage member along the circumference, secures sealability and the flange portion 332 is continuously in tight contact with an end face of the distal end portion 322 of the storage member along the circumference, secures sealability, and provides a double sealing structure, which is a structure that prevents leakage of the liquid.

Figure 8A:
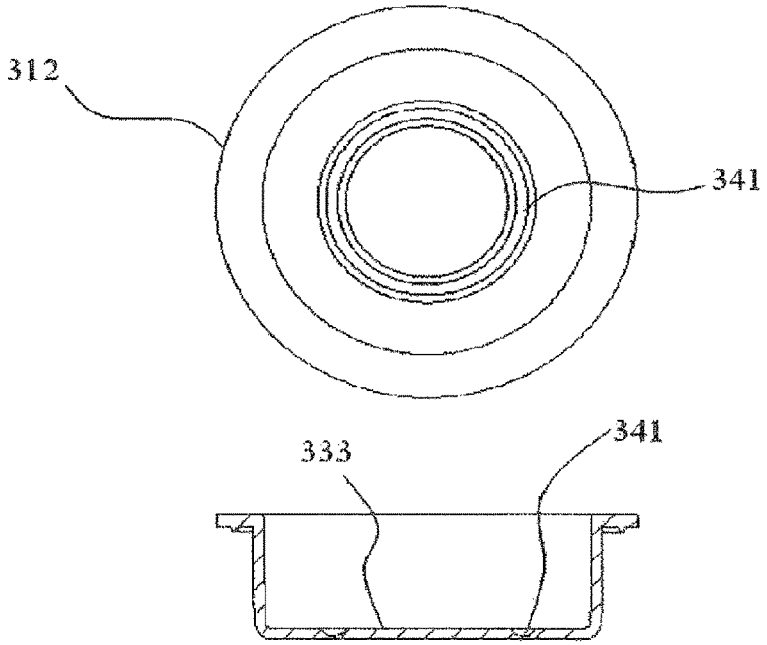
FIG. 8A is a diagram illustrating an example of the shape of the stopper member of the ink replenishment container according to Embodiment 1.
Figure 8B:
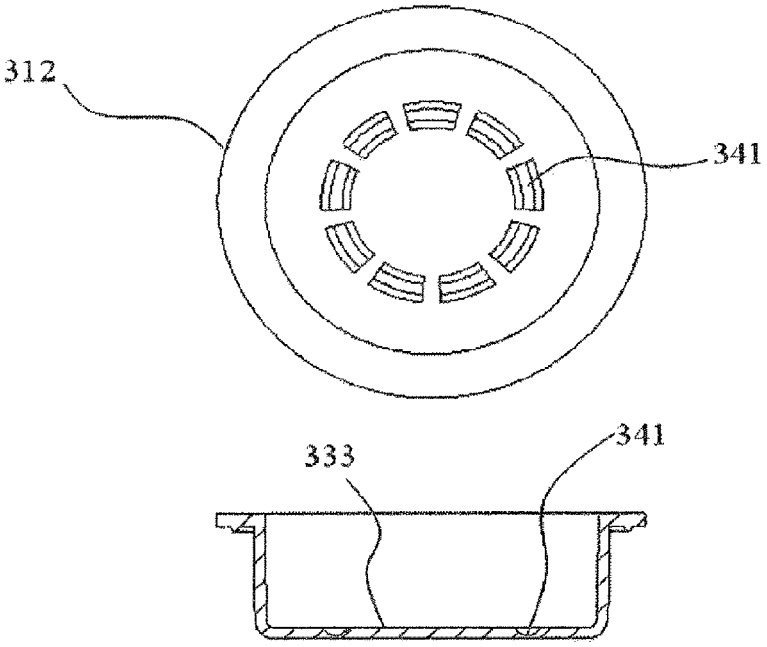
FIG. 8B is a diagram illustrating another example of the shape of the stopper member of the ink replenishment container according to Embodiment 1.

The base portion 333 of the stopper member 312 includes a ring-shaped thin wall portion 341 which has a smaller thickness than the surrounding area. In the present embodiment, when the ink replenishment container 301 is connected to the ink sub container 202 on the main unit side, part of the base portion 333 of the stopper member 312 of the ink replenishment container 301 is configured to be broken through by a protrusion of the connection portion provided in the ink sub container 202. This thin wall portion 341 is intended to be broken through by a small operation force when ink is replenished and the thickness of the thin wall portion is preferably on the order of 0.2 to 0.5 mm. FIG. 8 shows an example of the shape of the stopper member 312, FIG. 8(*a*) illustrating the thin wall portion 341 which is formed into a continuous ring shape and FIG. 8(*b*) illustrating the thin wall portion 341 which is intermittently formed.

Next, as shown in FIG. 1(*b*), the first lid member 313 includes a cylindrical portion 351 and a base portion 352, the inside surface of the cylindrical portion 351 is threaded to engage with and to be fixed to the thread formed at the distal end portion 322 of the storage member 311.

Figure 9A:
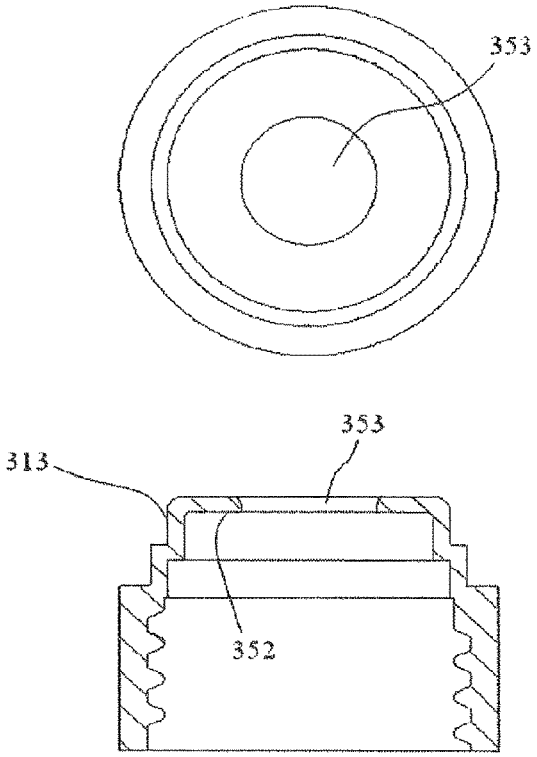
FIG. 9A is a diagram illustrating an example of the shape of the lid member of the ink replenishment container according to Embodiment 1.
Figure 9B:
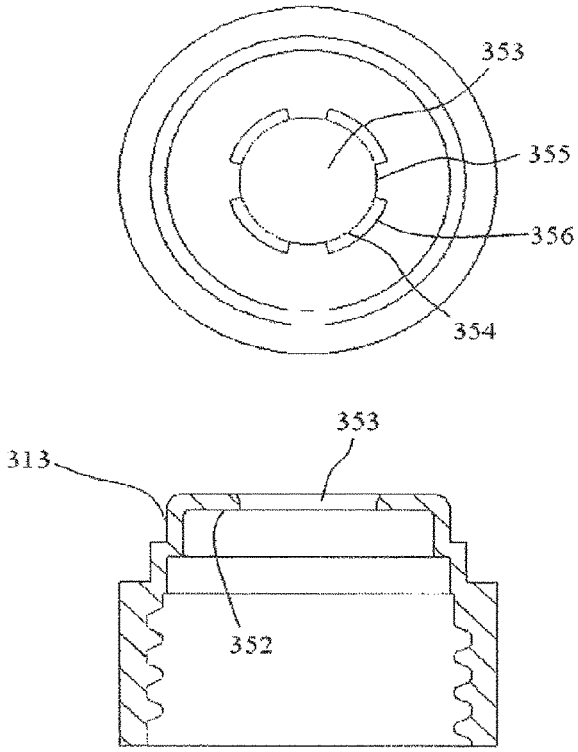
FIG. 9B is a diagram illustrating another example of the shape of the lid member of the ink replenishment container according to Embodiment 1.

The end face portion 352 of the first lid member includes a through hole 353 and the through hole 353 of the lid member is disposed concentrically with the ring-shaped thin wall portion 341 of the stopper member 312. FIG. 9 shows an example of the shape of the lid member 313, FIG. 9(*a*) illustrating the through hole 353 formed into a circular shape and FIG. 9(*b*) illustrating the through hole 353 formed of portions 355 along a circle 354 and concave portions 356 peripheral thereto.

Furthermore, the base portion 333 of the stopper member 312 is provided with the seal member 314 along the peripheral rim of the base portion 333. The seal member 314 is cylindrical and includes a through hole 361, the through hole 361 of the seal member 314 being provided with two ring-shaped protrusions 362 and 363 on the inside surface thereof, and the ring-shaped protrusions 362 and 363 being formed concentrically with the through hole 361 and disposed concentrically with the through hole 353 of the first lid member 313.

When, for example, the cylindrical member that moves in an axial direction concentrically with the ring-shaped protrusions in tight contact with the protrusions concerned moves while compressing the seal member 314, the ring-shaped protrusions on the inside surface of the seal member 314 have an effect of securing sealability by a surface pressure of the seal member 314 that locally increases at the ring-shaped protrusions, preventing an unnecessarily high surface pressure from being generated except in the ring-shaped protrusions and reducing a frictional force generated. Note that the number of ring-shaped protrusions is not limited to two, but may be one or three or more, or may not be provided with any protrusions if only sealability is secured.

Two ring-shaped protrusions 364 and 365 are formed on the outside surface of the seal member 314, and the ring-shaped protrusions 364 and 365 are continuously in tight contact with the inside surface of the cylindrical portion 331 of the stopper member and along the inner circumference and thereby secure sealability.

Here, the number of the ring-shaped protrusions on the outside surface is not limited to two, but may be one or three or more, or without any protrusion, the outside surface of the seal member may be continuously in contact with the inside surface of the stopper member and along the circumference. Furthermore, when the ink replenishment container 301 is not connected to an adapter to be connected to the ink replenishment container 301, sealability between the ring-shaped protrusions 364 and 365 on the outside surface of the seal member and the inside surface of the cylindrical portion 331 of the stopper member is unnecessary, these portions may not be in tight contact with each other or the seal member 314 may be deformed so as to be in tight contact with each other when the ink replenishment container 301 is connected to the adapter.

Inner diameters 372 and 373 of the ring-shaped protrusions 362 and 363 of the inside surface of the seal member 314 are smaller than an inner diameter 371 of the through hole 353 of the lid member. When cylindrical member as a cartridge connection portion of the ink sub container on the body side having an outer diameter which is smaller than but substantially equal to the inner diameter of the through hole 353 of the lid member is inserted concentrically through the through hole 353 of the lid member, this causes the ring-shaped protrusions 362 and 363 on the inside surface of the seal member 314 to be continuously in tight contact with the outside surface of the cylindrical member on the circumference, making it possible to secure sealability at the portions concerned.

Figure 10:
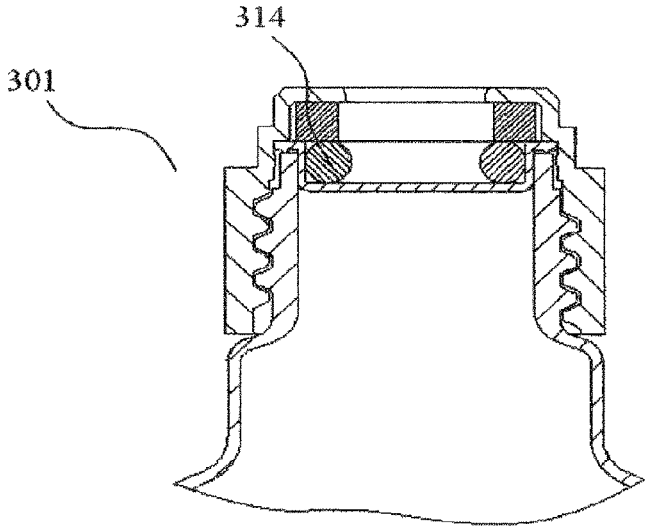
FIG. 10 is a diagram illustrating an example of the shape of the seal member of the ink replenishment container according to Embodiment 1.

The cylindrical member has a shape provided for an adapter to be connected to the ink replenishment container 301 and the adapter will be described later. FIG. 10 shows an example of the seal member 314, and the seal member may be ring-shaped or O-ring-shaped.

Next, the absorbing member 315 will be described. As an example of the material of the absorbing member 315, a polyolefin foamed body with continuous bubbles or a polyolefin non-woven fabric cloth is used as described above. Whatever is the material, the absorbing member 315 includes a gap which is continuous from the outer surface of the absorbing member 315 to the inside and a liquid can be absorbed into the gap.

The absorbing member 315 also includes a through hole 381 and the through hole 381 of the absorbing member is disposed concentrically with the through hole 353 of the lid member. As a method of fixing the absorbing member 315, for example, the absorbing member 315 and the seal member 314 are adhered and fixed to each other using a double-sided adhesive tape or an adhesive.

Figure 11A:
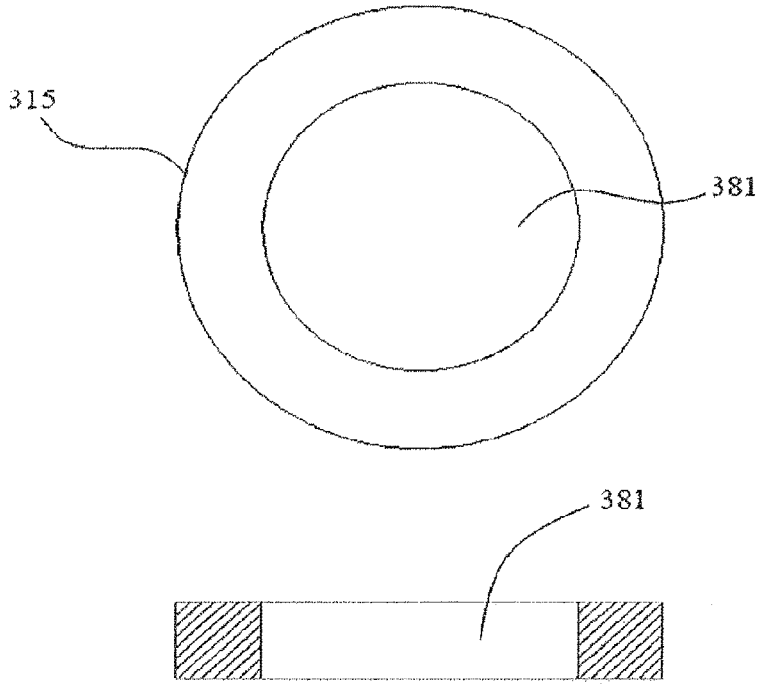
FIG. 11A is a diagram illustrating an example of the shape of an absorbing member of the ink replenishment container according to Embodiment 1.
Figure 11B:
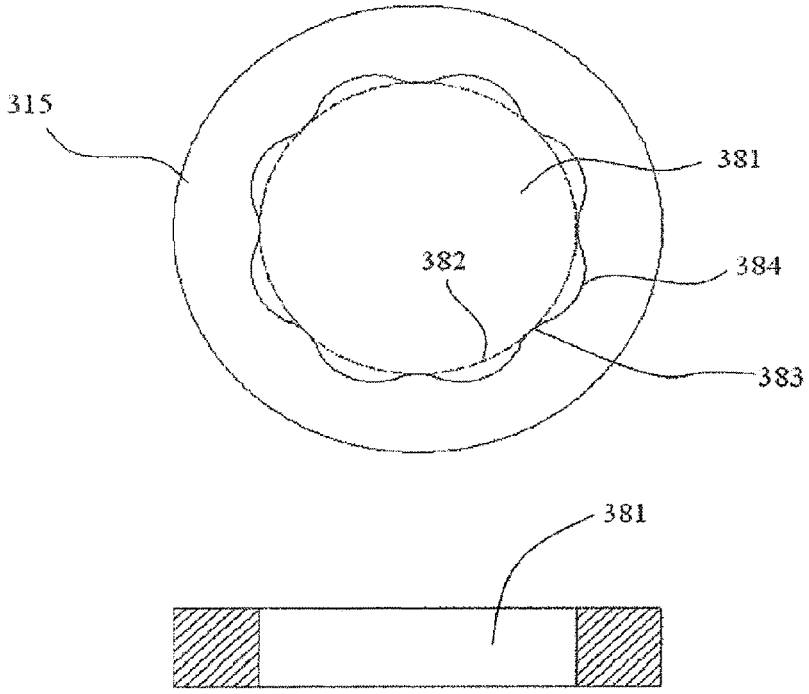
FIG. 11B is a diagram illustrating another example of the shape of the absorbing member of the ink replenishment container according to Embodiment 1.

FIG. 11 shows an example of the shape of the absorbing member 315, FIG. 11(*a*) illustrating the through hole 381 formed in a circular shape and FIG. 11(*b*) illustrating the through hole 381 formed of the portion 383 along a circle 382 and concave portions 384 peripheral thereto.

Next, the second lid member 316 will be described. As shown in FIG. 1, the second lid member 316 has a shape including a cylindrical portion 391 and a base portion 392 as an example, and is disposed so as to cover the through hole 353 of the lid member 313, thus preventing the stopper member 312, the seal member 314 or the absorbing member 315 from being damaged by mistake or preventing dirt from entering from outside and adhering when the ink replenishment container 301 is handled or stored.

The inside surface of the peripheral rim of the opening of the cylindrical portion 391 of the second lid member is provided with a ring-shaped protrusion 393, which engages with and is fixed to the lid member 313. This engagement is disengaged when the user manually pulls the second lid member in a direction of disengagement, and the ink replenishment container 301 is connected to the adapter with the second lid member 316 removed.

The second lid member 316 can be manually engaged with the lid member 313 and the second lid member 316 can be engaged with a used ink replenishment container. Provision of the second lid member 316 prevents a small amount of ink remaining in the used ink replenishment container from scattering outside due to impact or the like during handling or prevents smell of the ink inside from leaking outside.

Another example of the second lid member is a label, which is not shown, and may be pasted to the lid member 313 by covering the through hole 353. Note that the structure shown in FIG. 1 and the aforementioned contents regarding FIG. 1 are applicable to the solvent replenishment container 302 as well.

As described above, according to the ink or solvent replenishment container of the present embodiment, it is possible to provide a replenishment container capable of reducing staining by ink or a solvent during replenishment of the ink or solvent.

Next, the structure of the ink sub container 202 of the inkjet recording device 100 to which the ink replenishment container of the present embodiment is connected will be described using FIG. 12. A storage member 501 of the ink sub container includes a storage portion 511, a replenishment port 512 and a sensor port 513, and an adapter 502 is fixed to the replenishment port 512 using a screw 503. A seal member 504 is provided between the replenishment port 512 and the adapter 502 to secure sealability of the portions concerned.

A block 508 to which a liquid level sensor 505, a suction pipe 506 and an atmosphere opening pipe 507 are attached is fixed to the sensor port 513 of the storage member 501 through screw engagement of the lid 509.

The liquid level sensor 505 is made up of two metal rods, the two rods are electrically continuous at a position at which the liquid level of conductive ink is in contact with the two metal rods, whereas the two rods are not electrically continuous at a position at which the liquid level of the conductive ink is not in contact with the two metal rods, and based on this principle, it is possible to detect whether or not the liquid level has reached a detection level 521 at a certain one point.

A terminal or the like with which a conductor engages is fixed at the top of the two metal rods, and the conductor is connected to the liquid level detection circuit 116.

Figure 6:
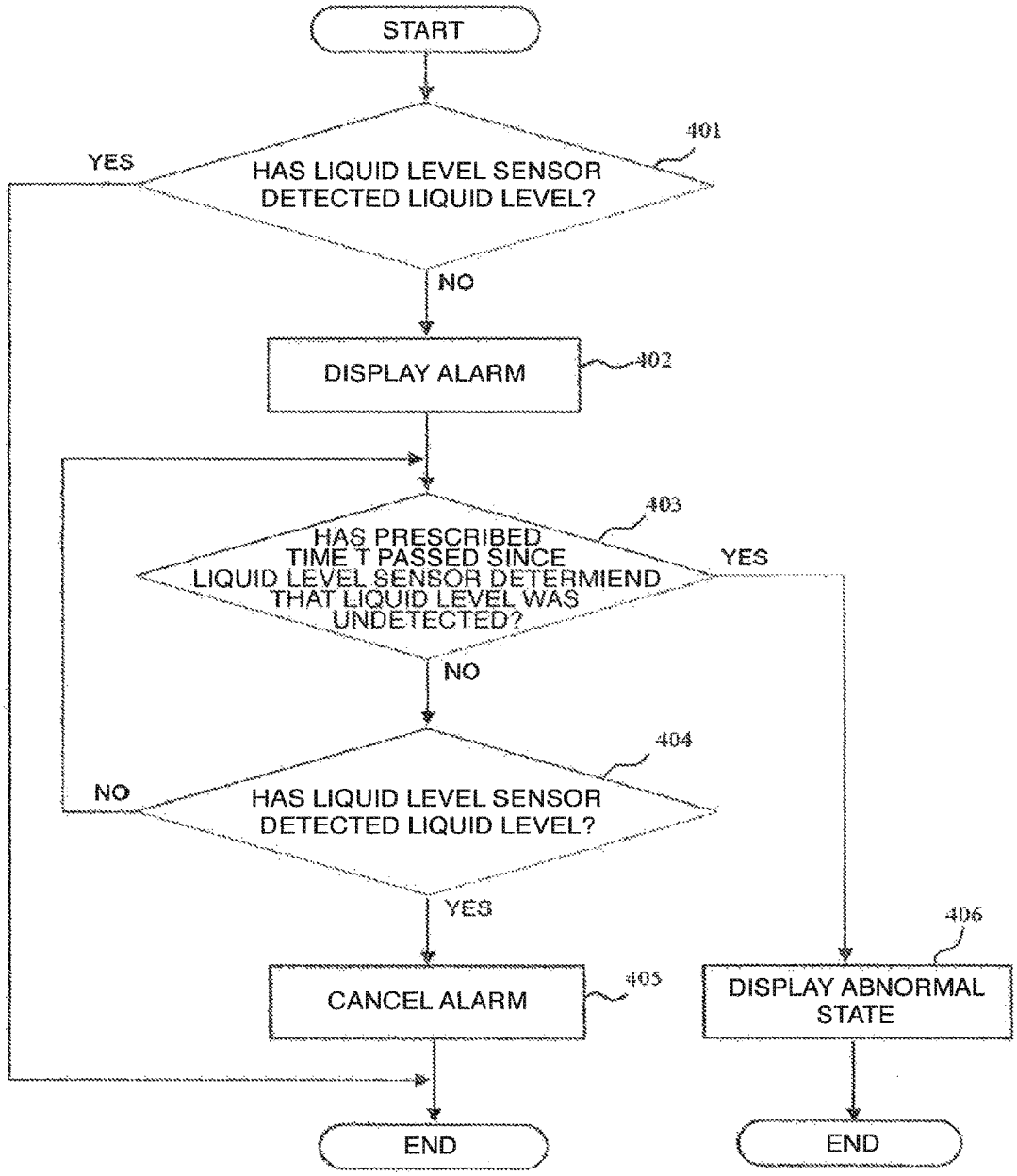
FIG. 6 is a diagram illustrating an example of a liquid level control flow of an ink sub container in the inkjet recording device mounted with the replenishment container according to Embodiment 1.

FIG. 6 illustrates an example of a liquid level control flow of the ink sub container 202 in the inkjet recording device 100. In step 401, it is confirmed, based on the detection level 521, whether or not the liquid level sensor 505 provided in the ink sub container 202 has detected the liquid level.

When the liquid level is not detected, this means that the ink in the ink sub container is running short and an alarm is displayed in step 402. The ink replenishment container connected to the ink sub container at this time discharges substantially all the ink stored therein into the ink sub container, and so the ink replenishment container is substantially empty.

Figure 12:
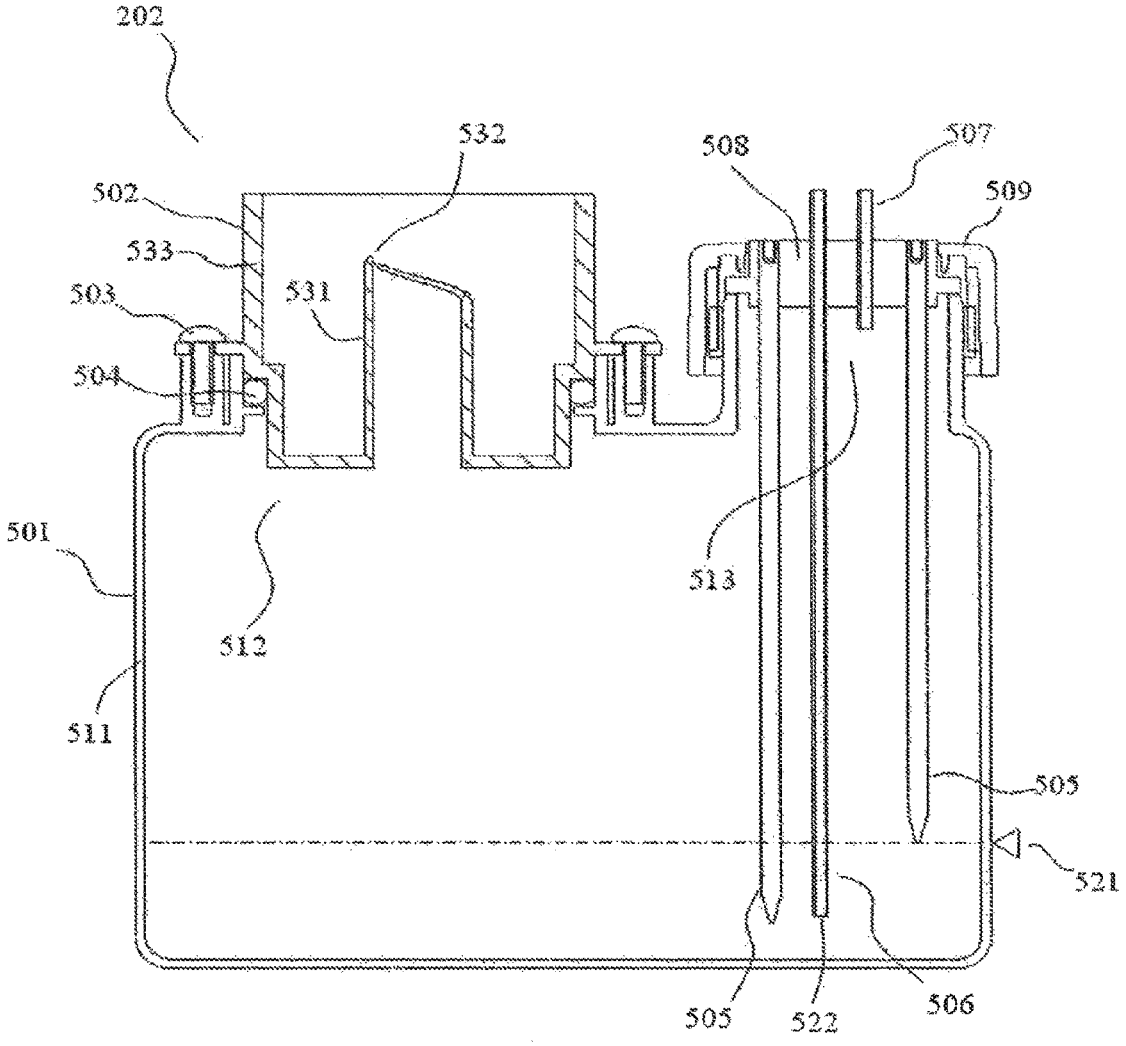
FIG. 12 is a cross-sectional view illustrating a structure of an ink sub container of the inkjet recording device mounted with the replenishment container according to Embodiment 1.

In FIG. 12, the drawing of the ink replenishment container is omitted. An example of a state of connection between the ink replenishment container and the ink sub container will be described later. As an example of alarm display in step 402, an alarm lamp of the state display lamp 5 is turned on, and an alarm mark and a message displaying contents that the ink replenishment container needs to be replaced by a new one within a prescribed time T are shown on the operation display section 3.

The alarm lamp and the alarm mark are normally displayed all the time until the alarm is canceled and the message can be erased by the user's operation. Even when the alarm is displayed, the inkjet recording device 100 can perform printing or operation as usual.

When the liquid level is detected in step 401, the amount of ink remaining in the ink sub container is sufficient, and so no alarm is displayed.

It is confirmed in step 403 whether or not the prescribed time T has passed since the liquid level was determined to be undetected. When the prescribed time T has passed, it is assumed that substantially no ink remains in the ink sub container depending on the operating environment or printing frequency and if printing is continued thereafter, there is a risk that air may be absorbed into the ink path instead of ink, causing printing disturbance, and therefore an abnormal state is displayed in step 406 and operation of the inkjet recording device 100 is stopped.

If the prescribed time T has not passed, it is confirmed in step 404 whether the liquid level has not been detected yet. If the liquid level has not been detected in step 404, the flow returns to step 403.

When the ink replenishment container is replaced by a new one, the ink in the ink replenishment container is discharged into the ink sub container, the liquid level in the ink sub container increases, the liquid level sensor detects the liquid level based on the detection level 521 and the flow proceeds to step 405.

In step 405, the alarm displayed in step 402 is canceled. The liquid level control flow shown in FIG. 6 is similar to that of the solvent sub container, and as an example of the alarm display in step 402 when the liquid level sensor of the solvent sub container does not detect the liquid level, a message with contents showing that the solvent replenishment container needs to be replaced by a new one within the prescribed time T is displayed.

The detection level 521 is provided at a position above the suction port 522 of the suction pipe 506 at a predetermined distance therefrom. This increases by a certain amount the time period after the amount of ink in the ink sub container 202 decreases due to printing during operation of the inkjet recording device 100, the liquid level falls below the detection level 521 and an alarm is issued until it is no longer possible to suction the ink, thus providing a time extension after the user recognizes the occurrence of the alarm until replacing the ink replenishment container 301.

A fluororesin tube is connected to an upper portion of the suction pipe 506 through engagement, connected to the ink circulation unit 261, and the path thereof is linked with the pump 211 via the electromagnetic valve 221. A fluororesin tube is connected to an upper portion of the atmosphere opening pipe 507 through engagement, and the path thereof is linked with an atmosphere outside the inkjet recording device 100, and when the ink in the ink sub container is suctioned by the suction pipe 506, air from the atmosphere opening pipe flows into the ink sub container. Since the solvent stored in the solvent sub container 203 has no conductivity under normal circumstances, the solvent sub container 203 uses a different type of liquid level sensor from the ink sub container, but follows the same liquid level control flow shown in FIG. 6 and adopts the same structure shown in FIG. 12 except the liquid level sensor. A float sensor or the like is used as the liquid level sensor of the solvent sub container. A structural diagram of the solvent sub container is omitted.

The adapter 502 is intended to be connected to the ink replenishment container 301 and a connection state thereof will be described later. The adapter 502 is provided with a cylindrical portion 531, an upper part of which forms an acute angle shape 532 and an outer wall portion 533. Polypropylene resin, polybutylene terephthalate resin or the like is used as the material of the adapter 502.

Figure 13A:
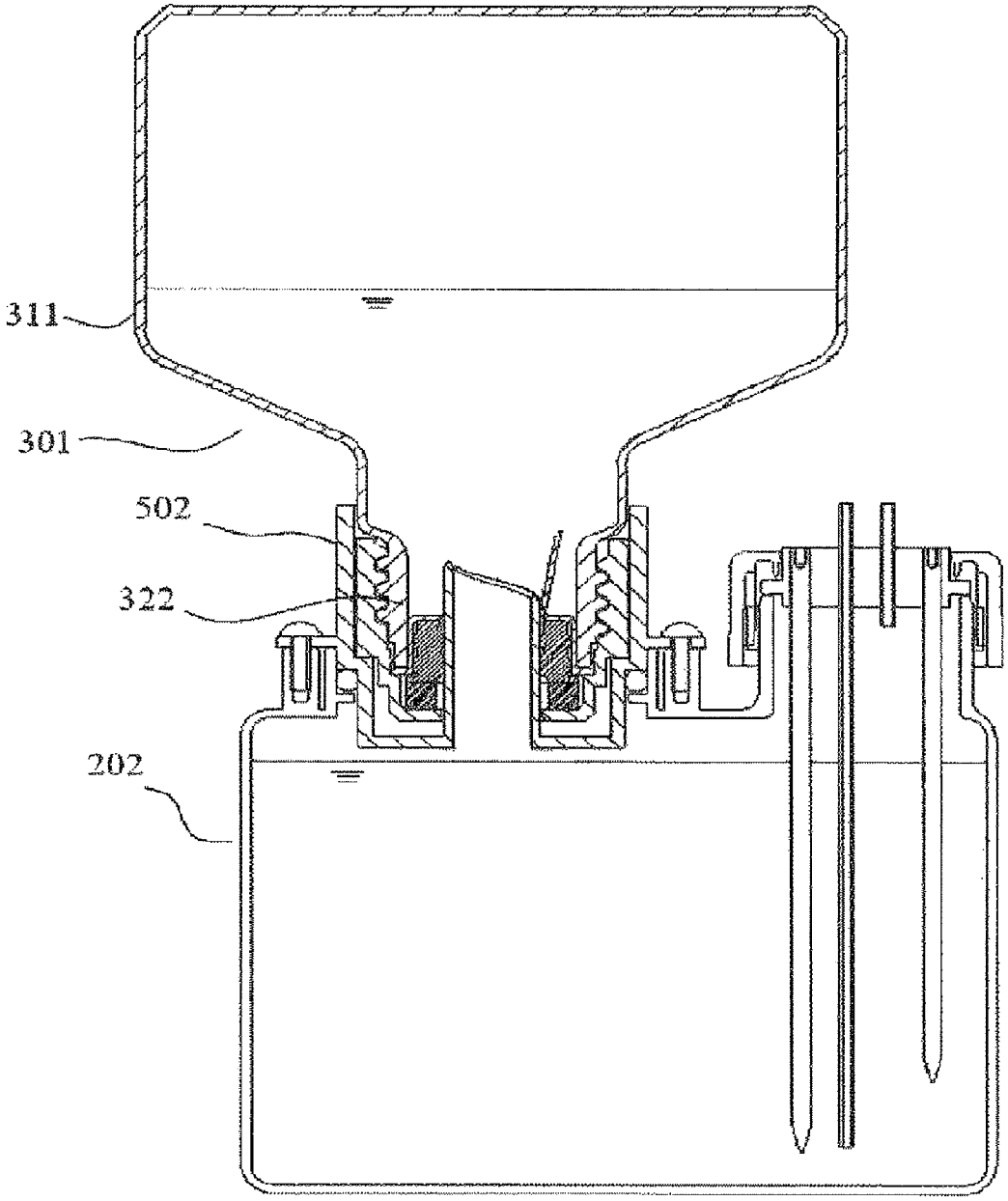
FIG. 13A is a cross-sectional view of overall appearance illustrating the ink replenishment container according to Embodiment 1 connected with the ink sub container.
Figure 13B:
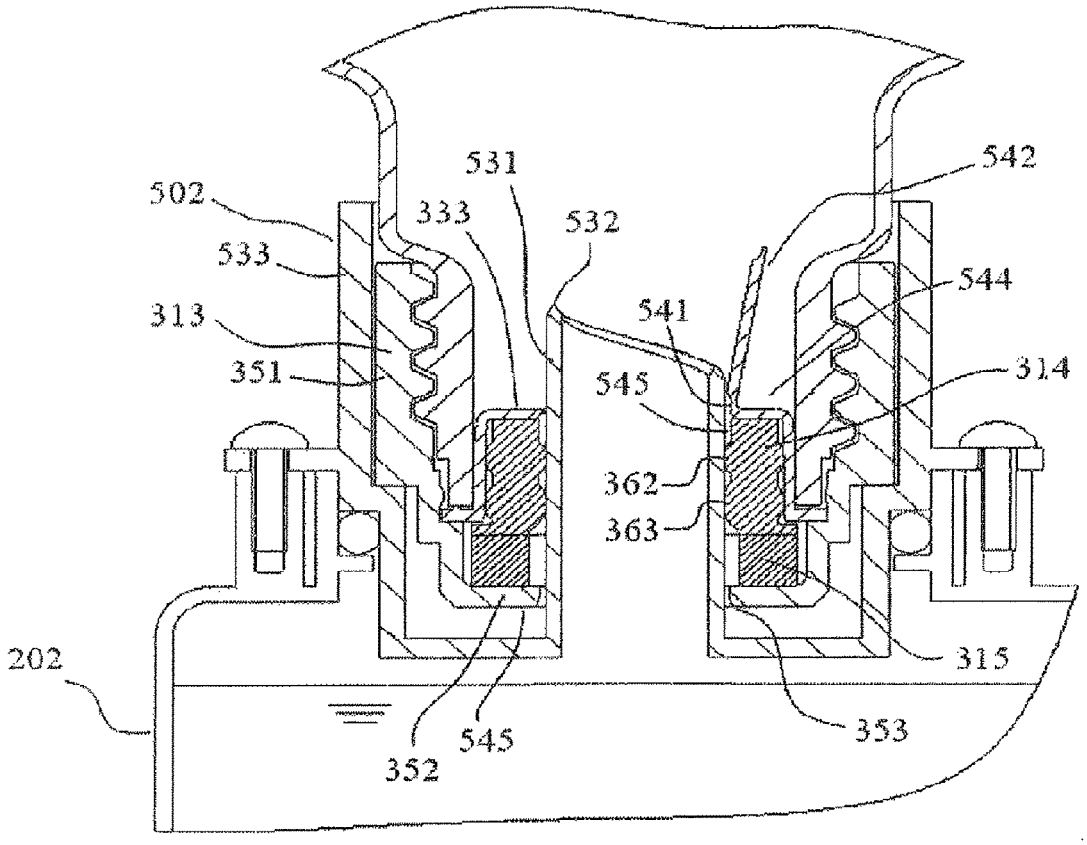
FIG. 13B is a cross-sectional view illustrating details of the area of connection between the ink replenishment container according to Embodiment 1 and the ink sub container.

FIG. 13 is a diagram illustrating an example of a state of connection between the ink replenishment container 301 and the ink sub container 202. FIG. 13(*a*) is an overall diagram and FIG. 13(*b*) is a detailed diagram of the connection portion. The ink replenishment container 301 is inserted into and connected to the ink sub container 202 with the distal end portion 322 of the storage member 311 placed face down.

The connection is made through engagement between the ring-shaped protrusions 362 and 363 of the inside surface of the through hole of the seal member 314 of the ink replenishment container 301 and the outside surface of the cylindrical portion 531 of the adapter 502 of the ink sub container, and the thin wall portion 341 of the stopper member 312 is broken through in a ring shape by the acute angle shape 532 above the cylindrical portion of the adapter during the connection leaving part of a connection portion 541.

At this time, a portion 542 inside the thin wall portion of the stopper member and broken through in a ring shape is pushed up by the cylindrical portion 531 which is the portion projecting above the base portion 333 of the stopper member and maintains a state in which the inside of the cylindrical portion 531 of the adapter which becomes a channel is not blocked.

The connection operation is the operation that the user removes the second lid member 316 from the ink replenishment container 301, then inserts the cylindrical portion 351 of the lid member 313 of the ink replenishment container 301 so as to be accommodated in the outer wall portion 533 of the adapter of the ink sub container 202, and then pushes the ink replenishment container 301 downward.

At this time, the outer wall portion 533 of the adapter of the ink sub container 202 has an inner diameter greater than an outer diameter of the cylindrical portion 351 of the lid member 313 of the ink replenishment container 301, but a difference therebetween is as small as on the order of 0.1 to 0.6 mm, and on the other hand, an outer diameter of the cylindrical portion 531 of the adapter is smaller than an inner diameter of the through hole 353 of the lid member 313, but a difference therebetween is as small as on the order of 0.1 to 0.6 mm and the respective portions play the role of guidance when inserting the ink replenishment container 301 into the adapter.

When the ink replenishment container 301 is pushed in, a certain degree of push-in force is necessary due to a frictional force between the cylindrical portion 531 of the adapter of the ink sub container 202 and the seal member 314 of the ink replenishment container 301 and a force required for the acute angle portion 531 of the cylindrical portion 531 of the adapter to break through the stopper member 312, but the ink replenishment container 301 can also be pushed in by the above-described operation.

Although the outer diameter of the cylindrical portion 531 of the adapter 502 is smaller than but substantially equal to the inner diameter of the through hole 353 of the lid member 313 of the ink replenishment container, and the inner diameter of the ring-shaped protrusions 362 and 363 on the inside surface of the seal member 314 is smaller than the outer diameter of the through hole 353 of the lid member and the cylindrical portion 531 of the adapter, whereby sealability of the portions concerned is secured as described above.

That is, this means that when the ink replenishment container 301 is connected to the ink sub container 202 and ink is replenished thereto, the ink is sealed by a portion of the ring-shaped protrusion 362 or 363 inside the ink replenishment container and stays there, and the outer surface of the ink replenishment container, for example, the outer surface 545 of the base portion 352 of the lid member 313 in particular is not stained by the ink, which allows the user to operate without the ink staining the user's hand even when the user's hand touches a given outer surface of the ink replenishment container when handling the used ink replenishment container.

Here, the outside surface of the cylindrical portion 531 of the adapter and the hole formed by the stopper member 312 being broken through are engaged with each other, but they are not always in tight contact with each other over the whole circumference, and sealability of the portions concerned cannot be stably secured. During the connection, the inside of the cylindrical portion 531 of the adapter becomes a channel which allows the ink to flow from the ink replenishment container to the ink sub container by its own weight, and at the same time allows the air to flow from the ink sub container to the ink replenishment container, thereby compensating for the volume that reduces by the outflow of ink in the ink replenishment container. In that case, if the inner diameter of the cylindrical portion 531 of the adapter is small, the ink may not drop off due to the action of surface tension or the like, and so the inner diameter of the adapter is preferably approximately 8 mm or more.

Moreover, in the present embodiment, the storage member 311 of the ink replenishment container 301 has a certain degree of rigidity and the volume of the ink replenishment container 301 substantially does not change, and as another example, the storage member 311 of the ink replenishment container may have small rigidity, and may be easily deformed and reduced in volume by a negative pressure generated when the ink therein flows by its own weight and an external force by which the storage member 311 is pressured and compressed.

The ink replenishment container 301 is connected to the ink sub container 202, raised by the user after causing most of the ink therein to flow out, and replaced with a new ink replenishment container. When the ink replenishment container is raised, there is a risk that a small amount of ink remaining in, for example, an upper space 544 of the stopper member 312 or an upper space 545 of the ring-shaped protrusion 362 of the seal member 314 may run along the inner surface of the through hole of the seal member 314 and flow out of the outer surface of the ink replenishment container, but to cope with such a possibility, arranging the absorbing member between the seal member 314 and the lid member 313 prevents the outflow of the remaining ink.

Figure 14:
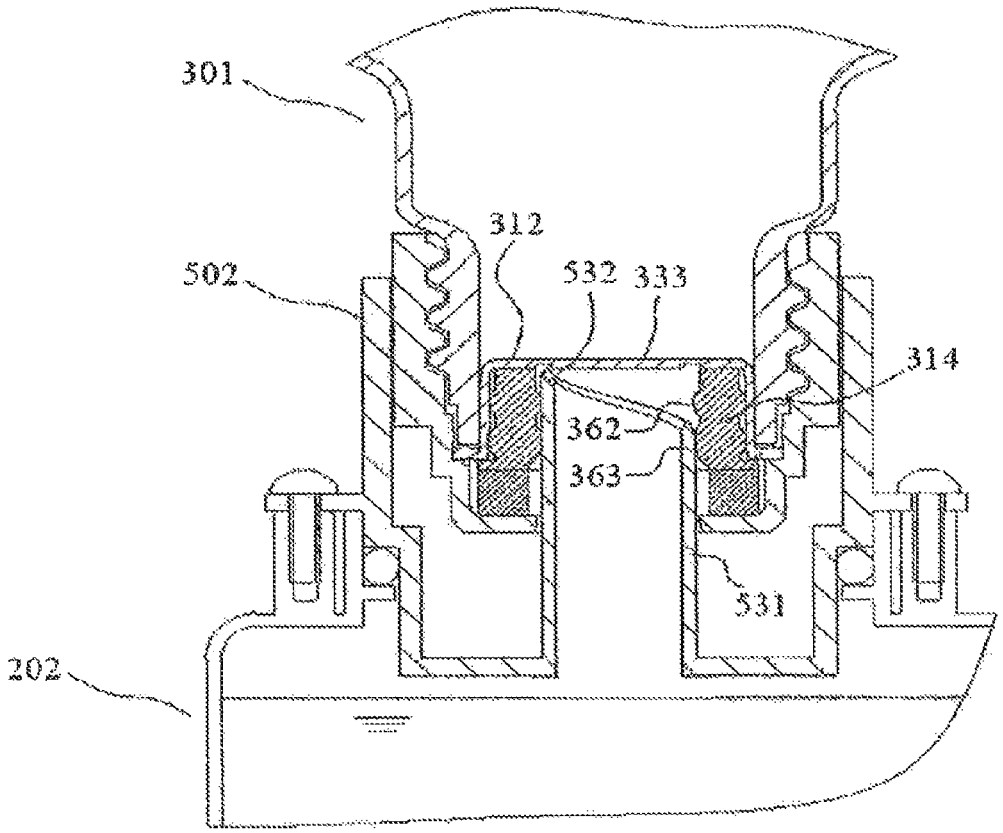
FIG. 14 is a cross-sectional view illustrating an example of a state in the middle of connection between the ink replenishment container according to Embodiment 1 and the ink sub container.

FIG. 14 is a diagram illustrating an example of a state midway through the connection between the ink replenishment container 301 and the ink sub container 202. The acute angle shape 532 of the cylindrical portion 531 of the adapter is not in contact with the base portion 333 of the stopper member 312 and the outside surface of the cylindrical portion 531 of the adapter is continuously in contact with the ring-shaped protrusion 363 of the seal member 314 along the circumference. Thus, sealability of the portions concerned is secured even midway through the connection between the ink replenishment container 301 and the ink sub container 202.

Embodiment 2

Figure 15A:
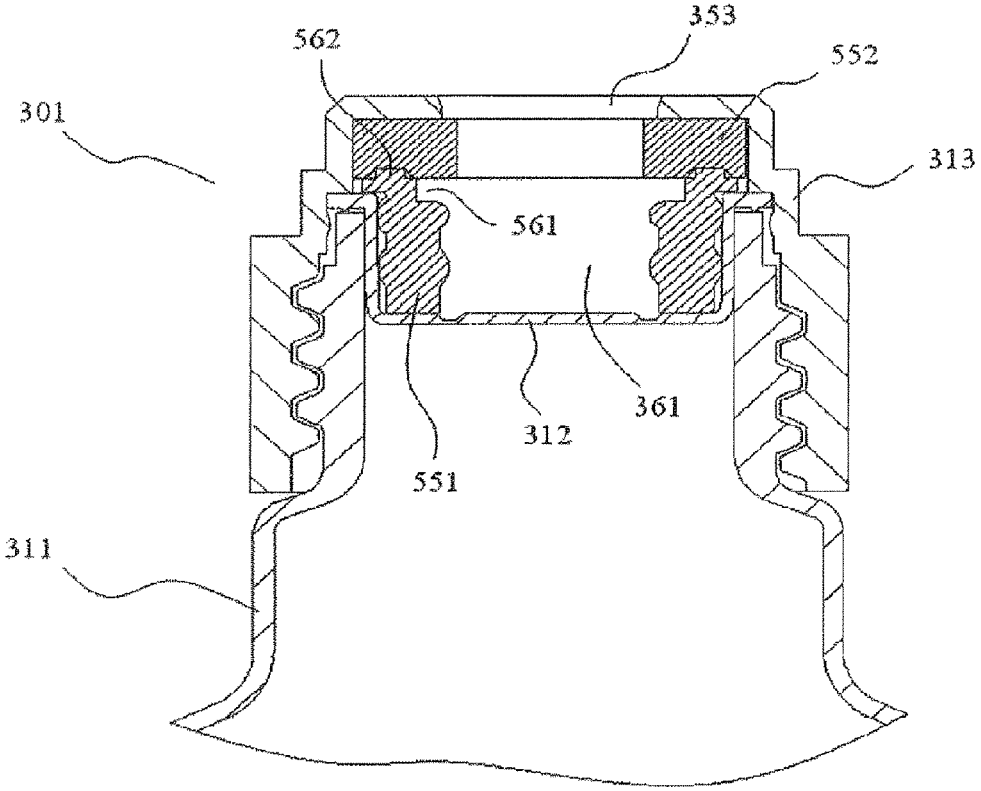
FIG. 15A is a cross-sectional view illustrating a structure of an ink replenishment container according to Embodiment 2.
Figure 15B:
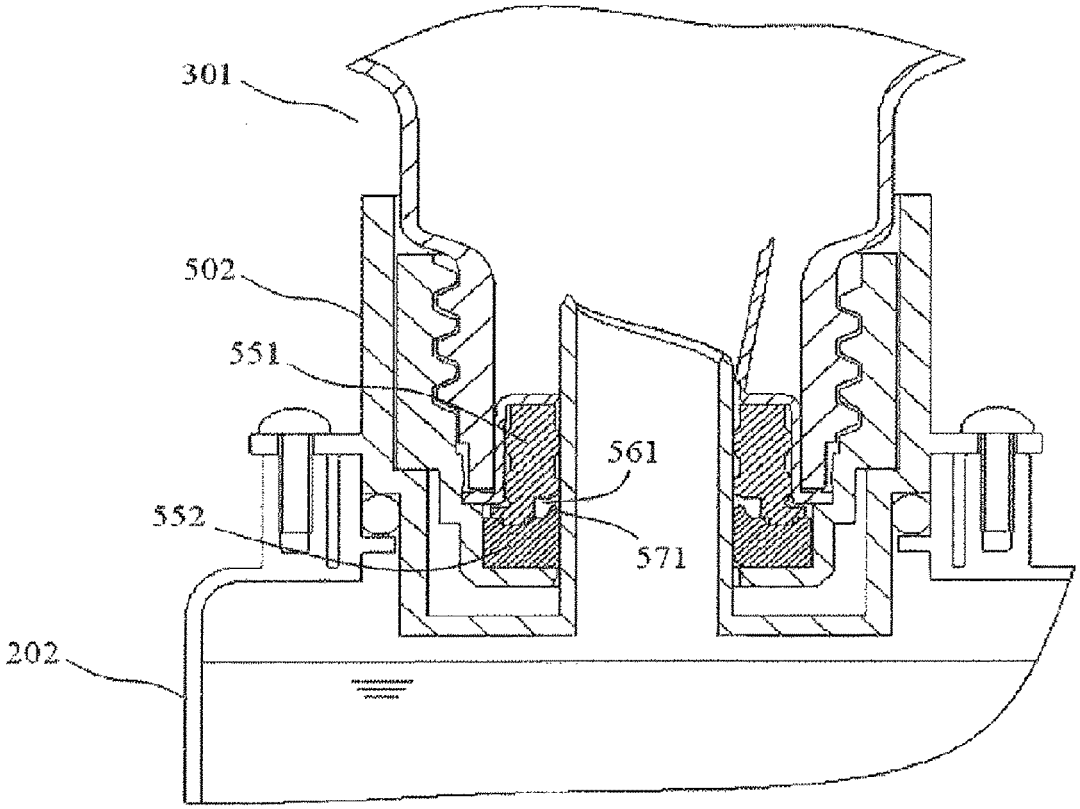
FIG. 15B is a cross-sectional view illustrating the ink replenishment container according to Embodiment 2 connected with an ink sub container.

FIG. 15 illustrates a configuration of an ink replenishment container 301 according to Embodiment 2, FIG. 15(*a*) illustrating a structure of the port of the ink replenishment container 301 and FIG. 15(*b*) illustrating an example of a state of connection between the ink replenishment container 301 and the ink sub container 202.

The ink replenishment container 301 is provided with a storage member 311, a stopper member 312, a lid member 313, a seal member 551, an absorbing member 552 and a second lid member 316. The present embodiment has contents similar to those described above regarding FIG. 1, and in this case, the seal member 314 corresponds to the seal member 551, and the absorbing member 315 corresponds to the absorbing member 552. In the present embodiment, parts of the shapes of the seal member 314 and the absorbing member 315 are changed and the changed portions will be described.

An inner diameter of a through hole 361 of the absorbing member 552 is smaller than an inner diameter of a through hole 353 of the lid member 313, and when the cylindrical portion 531 of the adapter is inserted into the portion concerned through the connection between the ink replenishment container 301 and the ink sub container 202, there is a relationship that the outside surface of the cylindrical portion of the adapter is in contact with the inside surface of the through hole of the absorbing member.

Thus, in the process in which the ink replenishment container 301 is raised from the ink sub container 202, even when engagement having sealability between the seal member 551 and the adapter cylindrical portion is disengaged and the aforementioned small amount of ink remaining in the ink replenishment container flows out onto the outer surface of the ink replenishment container, it is possible to reliably catch the ink through the absorbing member 552 and wipe away the ink adhered to the outside surface above the cylindrical portion of the adapter by the absorbing member 315 moving above the cylindrical portion while in contact with the cylindrical portion of the adapter. The seal member 551 has a circular concave portion 561 which is concentric with the through hole 361 thereof and the circular concave portion 561 is disposed opposite to the absorbing member 552. An inner diameter of the circular concave portion 561 is greater than an inner diameter of the through hole 353 of the lid member 313, and thus when the ink replenishment container 301 is connected to the ink sub container 202, the adapter cylindrical portion thereby comes into contact with the inner surface of the through hole of the absorbing member as described above, a flipped portion 571 is thereby generated in the absorbing member 552, but the flipped portion 571 is accommodated in the circular concave portion 561 of the seal member, preventing the flipped portion 571 from being involved in the contacting portion between the adapter cylindrical portion and the seal member. Regarding the method of fixing the absorbing member 552, for example, the absorbing member 552 is pushed in by the protrusion portion 562 provided in the seal member 551, a wedge-shaped engagement is formed and fixed. Note that the structure shown in FIG. 15 and the aforementioned contents regarding FIG. 15 are applicable to the solvent replenishment container 302 as well.

As described above, the invention according to the present embodiment can provide a replenishment container capable of reducing staining by ink or a solvent during replenishment of the ink or solvent.

Embodiment 3

Figure 16:
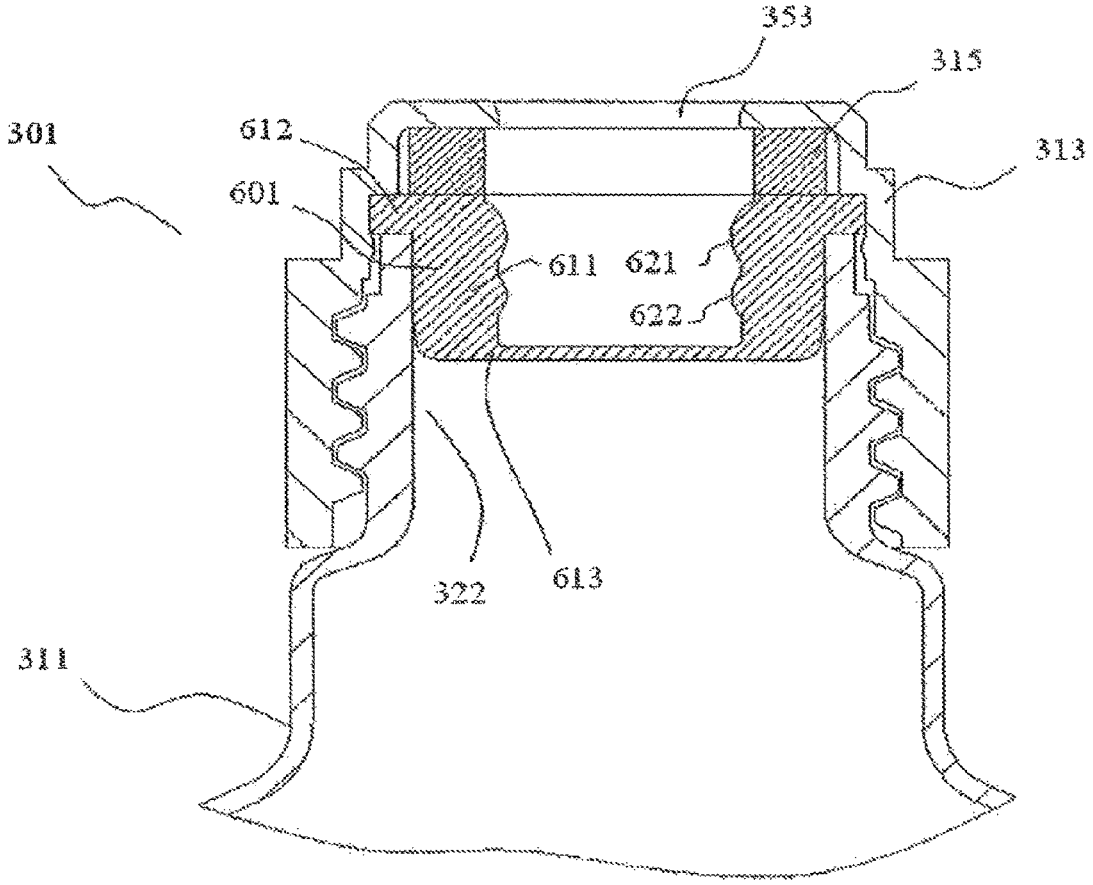
FIG. 16 is a cross-sectional view illustrating a structure of a port of an ink replenishment container according to Embodiment 3.

FIG. 16 illustrates a configuration of an ink replenishment container 301 according to Embodiment 3 and illustrates a structure of the distal end portion in particular. The present embodiment has a configuration and features similar to those of the ink replenishment container 301 shown in FIG. 1 except the difference in the stopper member 312 and the seal member 314, and the ink replenishment container 301 in the present embodiment is provided with a storage member 311, an elastic stopper member 601, a lid member 313, an absorbing member 315, and a second lid member 316. In FIG. 16, the second lid member is omitted.

The stopper member 601 is provided with a cylindrical portion 611, a flange portion 612, and a base portion 613, and an outside surface of the cylindrical portion 611 is continuously in tight contact with an inside surface of the distal end portion 322 of the storage member 311 along the circumference to secure sealability and the flange portion 612 is continuously in tight contact with an end face of the distal end portion 322 of the storage member 311 along the circumference to secure sealability.

As the material of the stopper member 601, an elastic body such as isobutylene-isoprene rubber or ethylene-propylene rubber is used. The shape of the base portion 613 may be a flat shape or concavo-convex shape. An inside surface of the cylindrical portion 611 of the stopper member 601 is provided with two ring-shaped protrusions 621 and 622, which are formed concentrically with the cylindrical portion 611. The ring-shaped protrusions 621 and 622 are disposed concentrically with the through hole 353 of the lid member 313.

Here, the number of ring-shaped protrusions on the inside surface is not limited to two, but may be one or three or more, or there may be no protrusions. Inner diameters of the ring-shaped protrusions 621 and 622 on the inside surface of the elastic stopper member are smaller than the inner diameter of the through hole 353 of the lid member, and effects thereof are the same as the aforementioned contents regarding the seal member 314. The state of connection with the ink sub container 202 is similar to the structure shown in FIG. 13. The structure shown in FIG. 16 and the aforementioned contents regarding FIG. 16 are applicable to the solvent replenishment container 302 as well.

As describe above, the invention according to the present embodiment can provide a replenishment container capable of reducing staining by ink or a solvent during replenishment of the ink or solvent.

Embodiment 4

Figure 17A:
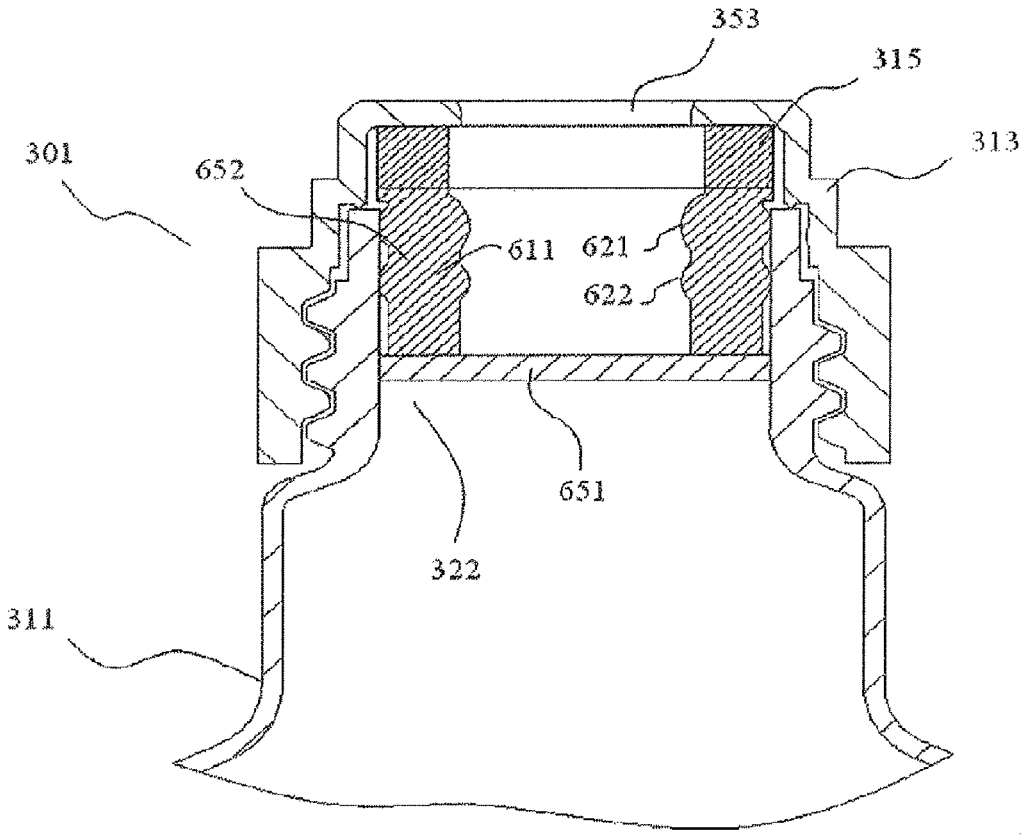
FIG. 17A is a cross-sectional view illustrating a structure of an ink replenishment container according to Embodiment 4.
Figure 17B:
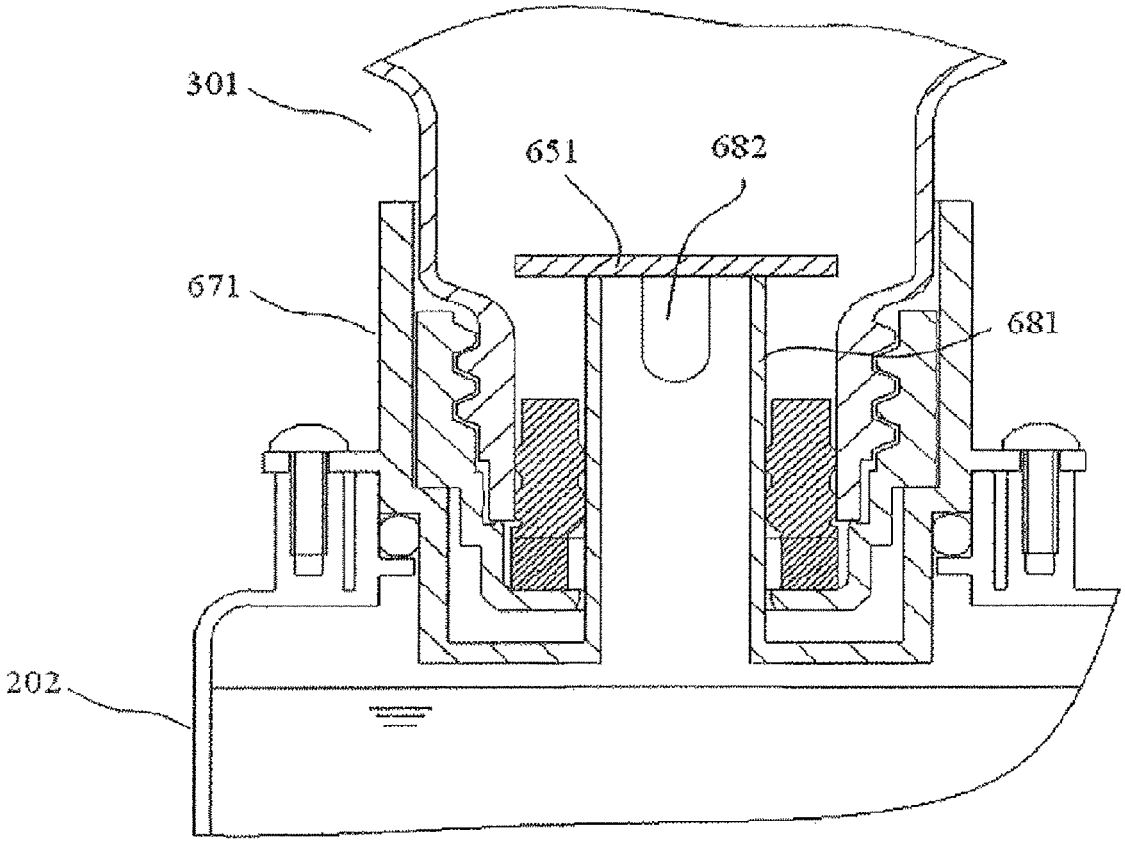
FIG. 17B is a cross-sectional view illustrating the ink replenishment container according to Embodiment 4 connected with an ink sub container.

FIG. 17 illustrates a configuration of an ink replenishment container 301 according to Embodiment 4, FIG. 17(*a*) illustrating a structure of a distal end portion of the ink replenishment container 301 and FIG. 17(*b*) illustrating an example of a state of connection between the ink replenishment container 301 and the ink sub container 202.

The present embodiment has a configuration and features similar to those of the ink replenishment container 301 shown in FIG. 1 except the difference in the stopper member 312 and the seal member 314, and the ink replenishment container 301 in the present embodiment is provided with a storage member 311, a stopper member 651, a seal member 652, a lid member 313, an absorbing member 315, and a second lid member 316. In FIG. 17, the second lid member is omitted.

The stopper member 651 is, for example, disk-shaped and fixed to the distal end portion 322 of the storage member 311 of the ink replenishment container 301 through engagement. Examples of the material used for the stopper member include low density polyethylene resin and linear low density polyethylene resin.

The outside surface of the stopper member 651 is continuously in contact with the inside surface of the distal end portion 322 of the storage member 311 of the ink replenishment container 301 along the circumference to thereby secure sealability. Furthermore, engagement between the stopper member 651 and the storage member 311 can be disengaged by adding an external force to the stopper member 651 in an axial direction. A seal member 652 is provided between the stopper member 651 and the lid member 313.

The seal member 652 has a cylindrical shape including a through hole, an inside surface of which is provided with ring-shaped protrusions 621 and 622, and the ring-shaped protrusions 621 and 622 are formed concentrically with the cylindrical shape of the seal member. The ring-shaped protrusions 621 and 622 are arranged concentrically with the through hole 353 of the lid member 313. Ring-shaped protrusions are formed on an outside surface of the seal member and the ring-shaped protrusions are continuously in tight contact with an inside surface of the distal end portion 322 of the storage member 311 along the circumference to thereby secure sealability.

The state of connection between the ink replenishment container 301 and the ink sub container 202 shown in FIG. 17(*b*) is a state in which the stopper member 651 is pushed up by a cylindrical shape 681 provided in the adapter 671 of the ink sub container 202, whereby engagement between the stopper member 651 and the storage member 311 of the ink replenishment container is disengaged and the interior of the ink replenishment container communicates with the interior of the ink sub container.

At this time, the stopper member 651 is not fixed and does not depend on the position shown in FIG. 17(*b*). Here, even if the stopper member 651 remains at the position shown in FIG. 17(*b*), the cylindrical shape 681 of the adapter is provided with a slit 682, providing a structure whereby the stopper member 651 that comes off does not block the channel. Other contents of the present embodiment are similar to the aforementioned contents regarding FIG. 13 and will be omitted. The structure shown in FIG. 17 and the aforementioned contents regarding FIG. 17 are applicable to the solvent replenishment container 302 as well.

As described above, the invention according to the present embodiment can provide a replenishment container capable of reducing staining by ink or a solvent during replenishment of the ink or solvent.

Embodiment 5

Figure 18A:
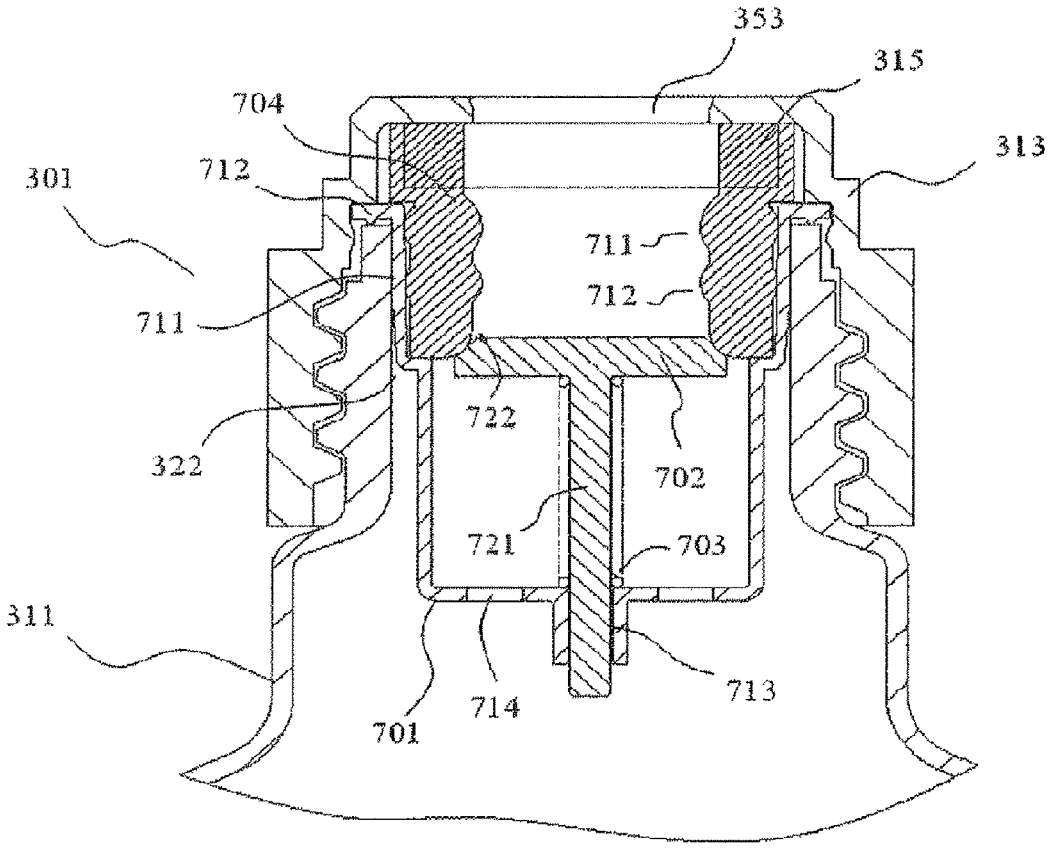
FIG. 18A is a cross-sectional view illustrating a structure of an ink replenishment container according to Embodiment 5.
Figure 18B:
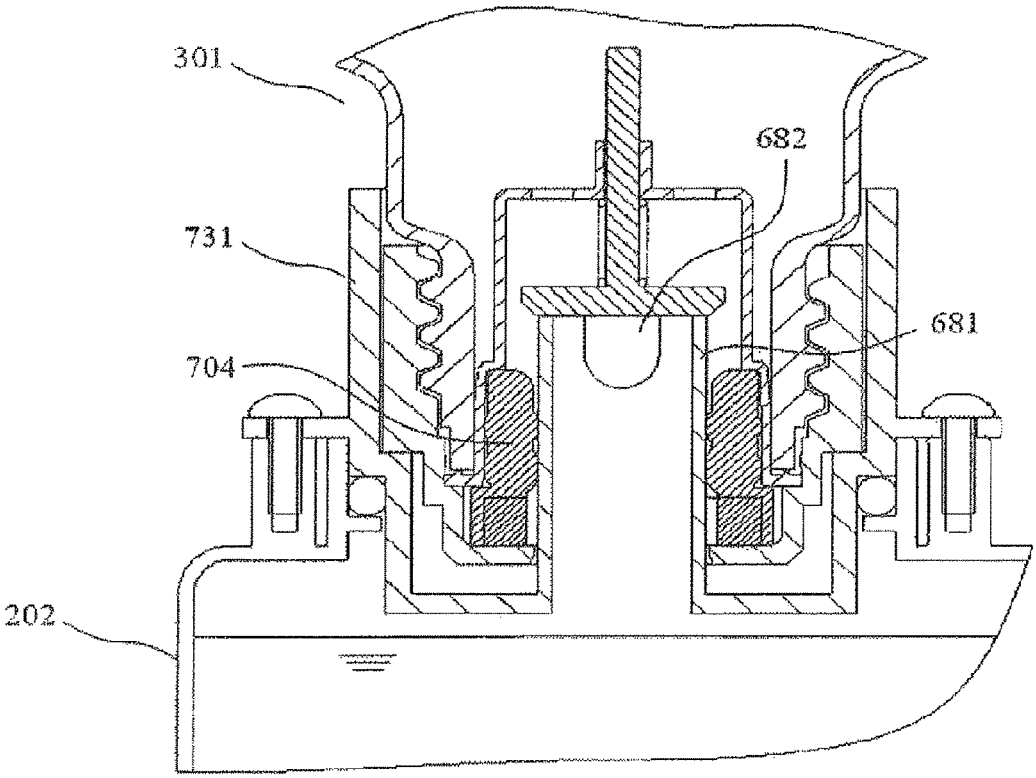
FIG. 18B is a cross-sectional view illustrating the ink replenishment container according to Embodiment 5 connected with an ink sub container.

FIG. 18 illustrates a configuration of an ink replenishment container 301 according to Embodiment 5, FIG. 18(*a*) illustrating a structure of a distal end portion of the ink replenishment container 301 and FIG. 18(*b*) illustrating an example of a state of connection between the ink replenishment container 301 and the ink sub container 202.

The present embodiment has a configuration and features similar to those of the ink replenishment container 301 shown in FIG. 1 except the difference in the stopper member 312 and the seal member 314, and the ink replenishment container 301 in the present embodiment is provided with a storage member 311, a first stopper member 701, a second stopper member 702, a compression coil spring 703, a seal member 704, a lid member 313, an absorbing member 315, and a second lid member 316. In FIG. 18, the second lid member is omitted.

Low density polyethylene resin or linear low density polyethylene resin is used as an example of the material of the first stopper member 701, polypropylene resin, high density polyethylene resin or polybutylene terephthalate resin is used for the second stopper member 702, and stainless steel is used for the compression coil spring 703.

The first stopper member 701 is provided with a cylindrical portion 711 and a flange portion 712, securing sealability with the distal end portion 322 of the storage member as in the case of the aforementioned contents regarding FIG. 1. Furthermore, the first stopper member 701 is provided with a guidance portion 713 and an opening 714.

The second stopper member 702 is provided with a shaft portion 721 and a valve portion 722, the shaft portion 721 engages with the guidance portion 713 of the stopper member 701 in a manner freely movable in the axial direction, the valve portion 722 receives a force of the compression coil spring 703, is pressed against the seal member 704 placed inside the cylindrical portion 711 of the stopper member 701 and the portion concerned is continuously in tight contact along the circumference to secure sealability.

In the state of connection between the ink replenishment container 301 and the ink sub container 202 shown in FIG. 18(*b*), the second stopper member 702 is pushed up by the adapter 731 of the ink sub container 202, the distance between the second stopper member 702 and the seal member 704 is increased and the interior of the ink replenishment container and the interior of the ink sub container communicate with each other.

At this time, the valve portion 722 of the second stopper member 702 is in close contact with the end face of the cylindrical portion 681 of the adapter, but the cylindrical shape 681 of the adapter is provided with a slit 682, providing a structure that does not block the channel.

Other contents of the present embodiment are similar to the aforementioned contents regarding FIG. 13, and are therefore omitted. Moreover, the structure shown in FIG. 18 and the aforementioned contents regarding FIG. 18 are applicable to the solvent replenishment container 302 as well.

As described above, the invention according to the present embodiment can provide a replenishment container capable of reducing staining by ink or a solvent during replenishment of the ink or solvent.

REFERENCE SIGNS LIST

1 . . . body, 2 . . . ink discharge head, 3 . . . operation display section, 4 . . . conduit, 5 . . . state display lamp, 6 . . . maintenance door, 13 . . . printing target, 15 . . . belt conveyor, 16 . . . encoder, 17 . . . printing sensor, 100 . . . inkjet recording device, 101 . . . MPU, 102 . . . ROM, 103 . . . RAM, 104 . . . input device, 105 . . . display device, 111 . . . excitation voltage generation circuit, 112 . . . charging voltage generation circuit, 113 . . . deflection voltage generation circuit, 114 . . . electromagnetic valve control circuit, 115 . . . pump control circuit, 116 . . . liquid level control circuit, 151 . . . nozzle, 152 . . . excitation element, 153 . . . charging electrode, 154 . . . deflection electrode, 161 . . . ink particles, 201 . . . ink container, 202 . . . ink sub container, 203 . . . solvent sub container, 211, 212, 213, 214 . . . pump, 221, 222, 223, 224, 225, 226, 227, 228 . . . electromagnetic valve, 229 . . . three-way electromagnetic valve, 231 . . . filter, 232 . . . decompression valve, 233 . . . pressure gauge, 234 . . . viscosity meter, 241 . . . gutter, 251 . . . ink circulation area, 261 . . . ink circulation unit, 301 . . . ink replenishment container, 302 . . . solvent replenishment container, 311 . . . storage member, 312 . . . stopper member, 313 . . . lid member, 314 . . . seal member, 315 . . . absorbing member, 316 . . . second lid member, 321 . . . storage chamber, 322 . . . port, 331 . . . cylindrical portion, 332 . . . flange portion, 333 . . . base portion, 341 . . . thin wall portion, 351 . . . cylindrical portion, 352 . . . base portion, 353 . . . through hole, 354 . . . circle, 355 . . . portion along circle, 356 . . . concaved portion, 361 . . . through hole, 362, 363 . . . ring-shaped protrusion, 364, 365 . . . ring-shaped protrusion, 371 . . . inner diameter of through hole, 372, 373 . . . inner diameter of ring-shaped protrusion, 381 . . . through hole, 382 . . . circle, 383 . . . concaved portion, 391 . . . cylindrical portion, 392 . . . base portion, 393 . . . ring-shaped protrusion, 501 . . . storage member, 502 . . . adapter, 503 . . . screw, 504 . . . seal member, 505 . . . liquid level sensor, 506 . . . suction pipe, 507 . . . atmosphere opening pipe, 508 . . . block, 509 . . . lid, 511 . . . storage portion, 512 . . . replenishment port, 513 . . . sensor port, 521 . . . detection level, 522 . . . suction port, 531 . . . cylindrical portion, 532 . . . acute angle shape, 533 . . . outer wall portion, 541 . . . connection portion, 543 . . . broken portion, 544 . . . upper space of stopper member, 545 . . . upper space of ring-shaped protrusion, 551 . . . seal member, 552 . . . absorbing member, 561 . . . circular concave portion, 571 . . . flipped portion, 601 . . . elastic stopper member, 611 . . . cylindrical portion, 612 . . . flange portion, 613 . . . base portion, 621, 622 . . . ring-shaped protrusion, 651 . . . stopper member, 652 . . . seal member, 671 . . . adapter, 681 . . . cylindrical shape, 682 . . . slit, 701 . . . stopper member, 702 . . . second stopper member, 703 . . . compression coil spring, 704 . . . seal member, 711 . . . cylindrical portion, 712 . . . flange portion, 713 . . . guidance portion, 714 . . . opening, 721 . . . shaft portion, 722 . . . valve portion

The invention claimed is:

1. A replenishment container comprising:

a storage member comprising a storage chamber that stores ink or a solvent and comprising an opening formed therein;

a stopper member configured to seal the opening of the storage member; and a lid member configured to cover the stopper member, wherein the replenishment container comprises a seal member that has a through hole between the stopper member and the lid member, the lid member comprises a through hole formed concentrically with the through hole of the seal member and an inner diameter of part or a whole of the through hole of the seal member is smaller than an inner diameter of the through hole of the lid member, and further comprising an absorbing member between the seal member and the lid member, the absorbing member having a through hole formed concentrically with a through hole provided in the seal member and the lid member, and wherein a thin wall portion, which has a smaller thickness than a surrounding area, is formed annularly in the stopper member.

2. The replenishment container according to claim 1, wherein the seal member is an elastic body.

3. The replenishment container according to claim 1, wherein the inner diameter of the through hole of the absorbing member is smaller than the inner diameter of the through hole of the lid member.

4. The replenishment container according to claim 3, wherein a gap is provided between the seal member and the absorbing member.

5. The replenishment container according to claim 4, wherein a protrusion is provided at one end portion of the seal member and the protrusion is in contact with the absorbing member.

6. The replenishment container according to claim 1, wherein the stopper member is provided so as to move toward a bottom surface direction of the storage portion.

7. An inkjet recording device comprising the replenishment container according to claim 1.

8. The replenishment container according to claim 1, wherein the thin wall portion is formed annularly and intermittently, or annularly and continuously.

9. The replenishment container according to claim 1, wherein the thin wall portion has a recessed shape at an opposite side to the storage chamber.

10. A replenishment container comprising:

a storage member comprising a storage chamber that stores ink or a solvent and comprising an opening formed therein;

a stopper member configured to seal the opening of the storage member; and a lid member configured to cover the stopper member, wherein the replenishment container comprises a seal member that has a through hole between the stopper member and the lid member, the lid member comprises a through hole formed concentrically with the through hole of the seal member and an inner diameter of part or a whole of the through hole of the seal member is smaller than an inner diameter of the through hole of the lid member, and further comprising an absorbing member between the seal member and the lid member, the absorbing member having a through hole formed concentrically with a through hole provided in the seal member and the lid member, and wherein the stopper member is used as a first stopper member, a through hole is provided at a central part of the first stopper member, the through hole is provided with a T-figured second stopper member and a spring is provided between the first stopper member and the second stopper member.

* * * * *